US010057693B2

(12) United States Patent
Andersen et al.

(10) Patent No.: US 10,057,693 B2
(45) Date of Patent: Aug. 21, 2018

(54) METHOD FOR PREDICTING THE INTELLIGIBILITY OF NOISY AND/OR ENHANCED SPEECH AND A BINAURAL HEARING SYSTEM

(71) Applicant: Oticon A/S, Smørum (DK)

(72) Inventors: Asger Heidemann Andersen, Smørum (DK); Jan Mark De Haan, Smørum (DK); Zheng-Hua Tan, Aalborg Øst (DK); Jesper Jensen, Smørum (DK); Michael Syskind Pedersen, Smørum (DK)

(73) Assignee: OTICON A/S, Smourm (DK)

( * ) Notice: Subject to any disclaimer, the term of this patent is extended or adjusted under 35 U.S.C. 154(b) by 0 days.

(21) Appl. No.: 15/457,694

(22) Filed: Mar. 13, 2017

(65) Prior Publication Data

US 2017/0272870 A1 Sep. 21, 2017

(30) Foreign Application Priority Data

Mar. 15, 2016 (EP) ..... 16160309

(51) Int. Cl.
*H04R 25/00* (2006.01)
*G10L 21/038* (2013.01)
(Continued)

(52) U.S. Cl.
CPC ..... *H04R 25/505* (2013.01); *G10L 19/00* (2013.01); *G10L 21/038* (2013.01); *G10L 25/06* (2013.01);
(Continued)

(58) Field of Classification Search
CPC .... H04R 25/70; H04R 25/50; H04R 2225/43; H04R 2225/41
(Continued)

(56) References Cited

U.S. PATENT DOCUMENTS

2011/0224976 A1 9/2011 Taal et al.
2011/0305345 A1 12/2011 Bouchard et al.
(Continued)

OTHER PUBLICATIONS

Andersen et al., "A binaural short time objective intelligibility measure for noisy and enhanced speech," Interspeech, Dresden, Germany, Sep. 6-10, 2015, pp. 2563-2567.
(Continued)

*Primary Examiner* — Melur Ramakrishnaiah
(74) *Attorney, Agent, or Firm* — Birch, Stewart, Kolasch & Birch, LLP

(57) ABSTRACT

An intrusive binaural speech intelligibility predictor system receives a target signal comprising speech in left and right essentially noise-free and noisy and/or processed versions at left and right ears of a listener. The system comprises a) first, second, third and fourth input units for providing time-frequency representations of said left and right noise-free and noisy/processed versions of the target signal, respectively; b) first and second Equalization-Cancellation stages adapted to receive and relatively time shift and amplitude adjust the left and right noise-free and noisy/processed versions, respectively, and to provide resulting noise-free and noisy/processed signals, respectively; and c) a monaural speech intelligibility predictor unit for providing final binaural speech intelligibility predictor value SI-Measure based on said resulting noise-free and noisy/processed signals. The Equalization-Cancellation stages are adapted to optimize the SI-Measure to indicate a maximum intelligibility of said noisy/processed versions of the target signal by said listener. The invention may e.g. be used in development systems for hearing aids.

19 Claims, 7 Drawing Sheets

(51) Int. Cl.
*G10L 25/06* (2013.01)
*G10L 19/00* (2013.01)

(52) U.S. Cl.
CPC ..... *H04R 25/552* (2013.01); *H04R 25/554* (2013.01); *H04R 2225/43* (2013.01); *H04R 2225/51* (2013.01)

(58) Field of Classification Search
USPC ..... 381/23.1, 312, 316, 317, 318, 320, 71.1, 381/71.11
See application file for complete search history.

(56) References Cited

U.S. PATENT DOCUMENTS

2014/0247956 A1 9/2014 Andersen et al.
2016/0234610 A1* 8/2016 Jensen ..... H04R 25/552

OTHER PUBLICATIONS

Andersen et al., "A method for predicting the intelligibility of noisy and non-linearly enhanced binaural speech," IEEE International Conference on Acoustics, Speech and Signal Processing (ICASSP), Shanghai, China, Mar. 20-25, 2016, pp. 4995-4999.
Bronkhorst, "The Cocktail Party Phenomenon: A Review of Research on Speech Intelligibility in Multiple-Talker Conditions," Acta Acustica United with Acustica, vol. 86, No. 1, Jan. 2000, pp, 117-128 (13 pages total).
Durlach, "Equalization and Cancellation Theory of Binaural Masking-Level Differences," J. Acoust. Soc. Am., vol. 35, No. 8, Aug. 1963, pp. 1206-1218.
Falk et al., "Objective Quality and Intelligibility Prediction for Users of Assistive Listening Devices," IEEE Signal Processing Magazine, vol. 32, No. 2, Mar. 2015, pp. 1-24.
Taal et al., "An Algorithm for Intelligibility Prediction of Time—Frequency Weighted Noisy Speech," IEEE Trans. Audio, Speech, Lang. Process., vol. 19, No. 7, Sep. 2011, pp. 2125-2136 (13 pages total).
Taal et al., "Matching pursuit for channel selection in cochlear implants based on an intelligibility metric," 2012 Proceedings of the 20th European Signal Processing Conference (EUSIPCO), Bucharest, Romania, Aug. 27-31, 2012, pp. 504-508.
Beutelmann et al., "Prediction of speech intelligibility in spatial noise and reverberation for normal-hearing and hearing-impaired listeners", J. Acoust. Soc. Am., vol. 120, No. 1, Jul. 2006, pp. 331-342.

* cited by examiner

METHOD FOR PREDICTING THE INTELLIGIBILITY OF NOISY AND/OR ENHANCED SPEECH AND A BINAURAL HEARING SYSTEM

The present application relates to speech intelligibility prediction for hearing aids. The disclosure relates e.g. to a method and a system for predicting the intelligibility of noisy and/or enhanced (processed) speech, and to a binaural hearing system implementing such method.

The design of hearing aids is typically guided by listening experiments with normal hearing or hearing impaired subjects. These listening tests are used to investigate the usefulness of novel audiological schemes or signal processing techniques. Furthermore, they are used to validate and evaluate the benefit of a hearing aid to the user, throughout the entire development process. These tests are expensive and time consuming. Currently, however, there is no real alternative to carrying out such experiments.

SUMMARY

In the present application, it is proposed to partly or fully replace the use of listening experiments with the use of a binaural intrusive speech intelligibility measure that is able to predict the impact of both noisy environments and hearing aid processing.

In the present context of speech intelligibility measures, the term 'binaural' is taken to refer to the advantage obtained by humans from combining information from the left and right ears. In the present context, the term 'intrusive' is taken to imply that for the calculation of the speech intelligibility measure, access to a clean speech signal (without noise, distortion or hearing aid processing) for reference is provided. An embodiment of the proposed structure or method is illustrated in FIG. 1D. The measure is able to predict the impact of various listening conditions (e.g. different rooms, different types of noise at different locations or different talker positions) and processing types (e.g. different hearing aids or hearing aid settings/algorithms). The measure relies on signals, which are typically available in the context of testing hearing aids. Specifically the measure is based on four input signals:

1) A noisy and potentially hearing aid processed speech signal from the left ear of a listener. This signal may be either recorded or simulated, or 'live' (e.g. picked up in-situ).
2) A noisy and potentially hearing aid processed speech signal from the right ear of a listener. This signal may be either recorded or simulated, or 'live' (e.g. picked up in-situ).
3) A clean speech signal from the left ear of a listener. This should be the same as the noisy/processed signal, but with neither noise nor hearing aid processing.
4) A clean speech signal from the right ear of a listener. This should be the same as the noisy/processed signal, but with neither noise nor hearing aid processing.

From these four input signals, the measure provides a number which describes how intelligible the noisy/processed signals are on average as judged by a group of listeners with similar listening abilities (or as judged by a particular user). The output may either be in the form of a simple "scoring" (e.g. a number between 0 and 1 where 0 is unintelligible and 1 is highly intelligible) or in the form of a direct prediction of the result of a listening test (e.g. the fraction of words understood correctly, the speech reception threshold and/or similar). The method is described in detail in [Andersen et al.; 2016], which is incorporated herein by reference.

Specifically, it is proposed to solve the above described task with a structure or method as shown in FIG. 1D. All four signals (or, alternatively, only the two noisy/processed signals) may or may not first be subjected to a first model (Hearing loss model in FIG. 1D), which emulate the hearing loss (or deviation from normal hearing), e.g. by adding noise and distortion to the signals to make the model predictions fit the performance of a subject with a particular hearing loss. Several such models exist, but a particularly simple example of a hearing loss model, is to add statistically independent noise, spectrally shaped according to the hearing loss in question, to the input signals. A second model (Binaural advantage in FIG. 1D) is then used to model the advantage of the subject having two ears. This model combines the left and right ear signals into a single clean signal and a single noisy/processed signal. This process requires one or more parameters, which determine how the left and right ear signals are combined, e.g. level differences and/or time differences between signals received at the left and right ears. The single clean and noisy processed signals are then sent to a monaural intelligibility measure (Monaural intelligibility measure in FIG. 1D), which does not take account of binaural advantage. The term 'monaural' is used (although signals from left and right ears are combined to a resulting signal) to indicate that one resulting (combined) signal is evaluated by the (monaural) speech intelligibility predictor unit. The 'monaural speech intelligibility predictor unit' evaluates speech intelligibility based on corresponding resulting essentially noise-free and noisy/processed target signals (as if they originated from a monaural setup, cf. e.g. FIG. 1D). Alternatively, other terms, e.g. 'channel speech intelligibility predictor unit', or simply 'speech intelligibility predictor unit', may be used. This provides a measure of intelligibility. The parameters required for the process of combining the left and right ear signals are determined such that the resulting speech intelligibility measure is maximized. The proposed structure allows using any model of binaural advantage together with any model of (e.g. monaural or binaural) speech intelligibility for processed signals, and obtain a binaural intelligibility measure, which handles processed signals. Embodiments of the present disclosure have the advantage of being computationally simple and thus well suited for use under power constraints, such as in a hearing aid.

A Binaural Speech Intelligibility System:

In an aspect of the present application, an intrusive binaural speech intelligibility prediction system is provided. The binaural speech intelligibility prediction system comprises a binaural speech intelligibility predictor unit adapted for receiving a target signal comprising speech in a) left and right essentially noise-free versions $x_l$, $x_r$ and in b) left and right noisy and/or processed versions $y_l$, $y_r$, said signals being received or being representative of acoustic signals as received at left and right ears of a listener, the binaural speech intelligibility predictor unit being configured to provide as an output a final binaural speech intelligibility predictor value SI measure indicative of the listener's perception of said noisy and/or processed versions $y_l$, $y_r$ of the target signal. The binaural speech intelligibility predictor unit further comprises First and second input units for providing time-frequency representations $x_l(k,m)$ and $y_l(k,m)$ of said left noise-free version $x_l$ and said noisy and/or processed version $y_l$ of the target signal, respectively, k being a frequency bin index, k=1, 2, . . . , K, and m being a time index;

Third and fourth input units for providing time-frequency representations $x_r(k,m)$ and $y_r(k,m)$ of said left noise-free version $x_r$ and said noisy and/or processed version $y_r$ of the target signal, respectively, k being a frequency bin index, k=1, 2, . . . , K, and m being a time index;

A first Equalization-Cancellation stage adapted to receive and relatively time shift and amplitude adjust the left and right noise-free versions $x_l(k,m)$ and $x_r(k,m)$, respectively, and to subsequently subtract the time shifted and amplitude adjusted left and right noise-free versions $x_l(k,m)$ and $x_r(k,m)$ of the left and right target signals from each other, and to provide a resulting noise-free signal x(k,m);

A second Equalization-Cancellation stage adapted to receive and relatively time shift and amplitude adjust the left and right noisy and/or processed versions $y_l(k,m)$ and $y_r(k,m)$, respectively, and to subsequently subtract the time shifted and amplitude adjusted left and right noisy and/or processed versions $y_l(k,m)$ and $y_r(k,m)$ of the left and right target signals from each other, and to provide a resulting noisy and/or processed signal y(k,m); and A monaural speech intelligibility predictor unit for providing final binaural speech intelligibility predictor value, SI measure, based on said resulting noise-free signal x(k,m) and said resulting noisy and/or processed signal y(k,m);

Wherein said first and second Equalization-Cancellation stages are adapted to optimize the final binaural speech intelligibility predictor value SI measure to indicate a maximum intelligibility of said noisy and/or processed versions $y_l$, $y_r$ of the target signal by said listener.

Thereby an improved speech intelligibility predictor can be provided.

In an embodiment, the intrusive binaural speech intelligibility prediction system, e.g. the first and second Equalization-Cancellation stages and the monaural speech intelligibility predictor unit, is/are configured to repeat the calculations performed by the respective units to optimize the final binaural speech intelligibility predictor value to indicate a maximum intelligibility of said noisy and/or processed versions of the target signal by said listener. In an embodiment, the first and second Equalization-Cancellation stages and the monaural speech intelligibility predictor unit are configured to repeat the calculations performed by the respective units for different time shifts and amplitude adjustments of the left and right noise-free versions $x_l(k,m)$ and $x_r(k,m)$, respectively, and of the left and right noisy and/or processed versions $y_l(k,m)$ and $y_r(k,m)$, respectively, to optimize the final binaural speech intelligibility predictor value to indicate a maximum intelligibility of said noisy and/or processed versions of the target signal by said listener.

In an embodiment, the first and second Equalization-Cancellation stages are configured to make respective exhaustive calculations for all combinations of time shifts and amplitude adjustments, e.g. for a discrete set of values, e.g. within respective realistic ranges. In an embodiment, the first and second Equalization-Cancellation stages are configured to use other schemes (e.g. algorithms) for estimating optimal value of the final binaural speech intelligibility predictor value (SI measure), e.g. steepest descent, or gradient based algorithms.

In an embodiment, the monaural speech intelligibility predictor unit comprises

A first envelope extraction unit for providing a time-frequency sub-band representation of the resulting noise-free signal x(k,m) in the form of temporal envelopes, or functions thereof, of said resulting noise-free signal providing time-frequency sub-band signals X(q, m), q being a frequency sub-band index, q=1, 2, . . . , Q, and m being the time index;

A second envelope extraction unit for providing a time-frequency sub-band representation of the resulting noisy and/or processed signal y(k,m) in the form of temporal envelopes, or functions thereof, of said resulting noisy and/or processed signal providing time-frequency sub-band signals Y(q,m), q being a frequency sub-band index, q=1, 2, . . . , Q, and m being the time index;

A first time-frequency segment division unit for dividing said time-frequency sub-band representation X(q,m) of the resulting noise-free signal x(k,m) into time-frequency envelope segments x(q,m) corresponding to a number N of successive samples of said sub-band signals;

A second time-frequency segment division unit for dividing said time-frequency sub-band representation Y(q, m) of the noisy and/or processed signal y(k,m) into time-frequency envelope segments y(q,m) corresponding to a number N of successive samples of said sub-band signals;

A correlation coefficient unit adapted to compute a correlation coefficient $\hat{\rho}(q,m)$ between each time frequency envelope segment of the noise-free signal and the corresponding envelope segment of the noisy and/or processed signal;

A final speech intelligibility measure unit providing a final binaural speech intelligibility predictor value SI measure as a weighted combination of the computed correlation coefficients across time frames and frequency sub-bands.

In an embodiment, the binaural speech intelligibility prediction system comprises a binaural hearing loss model. In an embodiment, the binaural hearing loss model comprises respective monaural hearing loss models of the left and right ears of a user.

A Binaural Hearing System:

In a further aspect, a binaural hearing system comprising left and right hearing aids adapted to be located at left and right ears of a user, and an intrusive binaural speech intelligibility prediction system as described above, in the 'detailed description of embodiments', and in the claims is moreover provided.

In an embodiment, the left and right hearing aids each comprises left and right configurable signal processing units configured for processing the left and right noisy and/or processed versions $y_l$, $y_r$, of the target signal, respectively, and providing left and right processed signals $u_{left}$, $u_{right}$, respectively, and left and right output units for creating output stimuli configured to be perceivable by the user as sound based on left and right electric output signals, either in the form of the left and right processed signals $u_{left}$, $u_{right}$, respectively, or signals derived therefrom.

The binaural hearing system further comprises a) a binaural hearing loss model unit operatively connected to the intrusive binaural speech intelligibility predictor unit and configured to apply a frequency dependent modification reflecting a hearing impairment of the corresponding left and right ears of the user to the electric output signals to provide respective modified electric output signals to the intrusive binaural speech intelligibility predictor unit.

The binaural speech intelligibility prediction system (possibly including the binaural hearing loss model) may be implemented in any one (or both) of the left and right hearing aids. Alternatively (or additionally), the binaural speech intelligibility prediction system may be implemented in a (separate) auxiliary device, e.g. a remote control device (e.g. a smartphone or the like).

In an embodiment, the hearing aid(s) comprise(s) an antenna and transceiver circuitry for wirelessly receiving a direct electric input signal from another device, e.g. a communication device or another hearing aid. In an embodiment, the left and right hearing aids comprises antenna and transceiver circuitry for establishing an interaural link between them allowing the exchange of data between them, including audio and/or control data or information signals. In general, a wireless link established by antenna and transceiver circuitry of the hearing aid can be of any type. In an embodiment, the wireless link is used under power constraints, e.g. in that the hearing aid comprises a portable (typically battery driven) device.

In an embodiment, the hearing aids (e.g. the configurable signal processing unit) are adapted to provide a frequency dependent gain and/or a level dependent compression and/or a transposition (with or without frequency compression) of one or frequency ranges to one or more other frequency ranges, e.g. to compensate for a hearing impairment of a user.

In an embodiment, each of the hearing aids comprises an output unit. In an embodiment, the output unit comprises a number of electrodes of a cochlear implant. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing aid).

In an embodiment, the input unit comprises an input transducer for converting an input sound to an electric input signal. In an embodiment, the input unit comprises a wireless receiver for receiving a wireless signal comprising sound and for providing an electric input signal representing said sound. In an embodiment, the hearing aid(s) comprise(s) a directional microphone system adapted to enhance a target acoustic source among a multitude of acoustic sources in the local environment of the user wearing the hearing aid.

In an embodiment, the hearing aid(s) comprise(s) a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing aid(s) comprise(s) an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing aid(s) comprise(s) an analogue-to-digital (AD) converter to digitize an analogue input with a predefined sampling rate, e.g. 20 kHz. In an embodiment, the hearing aid(s) comprise(s) a digital-to-analogue (DA) converter to convert a digital signal to an analogue output signal, e.g. for being presented to a user via an output transducer.

In an embodiment, the hearing aid(s) comprise(s) a number of detectors configured to provide status signals relating to a current physical environment of the hearing aid(s) (e.g. the current acoustic environment), and/or to a current state of the user wearing the hearing aid(s), and/or to a current state or mode of operation of the hearing aid(s). Alternatively or additionally, one or more detectors may form part of an external device in communication (e.g. wirelessly) with the hearing aid(s). An external device may e.g. comprise another hearing aid, a remote control, and audio delivery device, a telephone (e.g. a Smartphone), an external sensor, etc. In an embodiment, one or more of the number of detectors operate(s) on the full band signal (time domain). In an embodiment, one or more of the number of detectors operate(s) on band split signals ((time-) frequency domain).

In an embodiment, the hearing aid(s) further comprise(s) other relevant functionality for the application in question, e.g. compression, noise reduction, feedback.

In an embodiment, the hearing aid comprises a hearing instrument, e.g. a hearing instrument adapted for being located at the ear or fully or partially in the ear canal of a user or fully or partially implemented in the head of a user, a headset, an earphone, an ear protection device or a combination thereof.

In an embodiment, the hearing system further an auxiliary device. In an embodiment, the system is adapted to establish a communication link between the hearing aid(s) and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing aid. In an embodiment, the auxiliary device is or comprises a remote control for controlling functionality and operation of the hearing aid(s). In an embodiment, the function of a remote control is implemented in a SmartPhone, the SmartPhone possibly running an APP allowing to control the functionality of the audio processing device via the SmartPhone (the hearing aid(s) comprising an appropriate wireless interface to the SmartPhone, e.g. based on Bluetooth or some other standardized or proprietary scheme).

Use:

In an aspect, use of a binaural speech intelligibility system as described above, in the 'detailed description of embodiments' and in the claims, is moreover provided. In an embodiment, use is provided for performing a listening test. In an embodiment, use is provided in a system comprising one or more hearing instruments, headsets, ear phones, active ear protection systems, etc. In an embodiment, use is provided for enhancing speech in a binaural hearing aid system.

A Method of Providing a Binaural Speech Intelligibility Predictor Value:

In an aspect, a method of providing a binaural speech intelligibility predictor value is provided. The method comprises S1. receiving a target signal comprising speech in a) left and right essentially noise-free versions $x_l$, $x_r$ and in b) left and right noisy and/or processed versions $y_l$, $y_r$, said signals being received or being representative of acoustic signals as received at left and right ears of a listener is furthermore provided by the present application.

S2. providing time-frequency representations $x_l(k,m)$ and $y_l(k,m)$ of said left noise-free version $x_l$ and said noisy and/or processed version $y_l$ of the target signal, respectively, k being a frequency bin index, k=1, 2, . . . , K, and m being a time index;

S3. providing time-frequency representations $x_r(k,m)$ and $y_r(k,m)$ of said left noise-free version $x_r$ and said noisy and/or processed version $y_r$ of the target signal, respectively, k being a frequency bin index, k=1, 2, . . . , K, and m being a time index;

S4. receiving and relatively time shifting and amplitude adjusting the left and right noise-free versions $x_l(k,m)$ and $x_r(k,m)$, respectively, and subsequently subtracting the time shifted and amplitude adjusted left and right noise-free versions $x_l(k,m)$ and $x_r(k,m)$ of the left and right target signals from each other, and providing a resulting noise-free signal x(k,m);

S5. receiving and relatively time shifting and amplitude adjusting the left and right noisy and/or processed versions $y_l(k,m)$ and $y_r(k,m)$, respectively, and subsequently subtracting the time shifted and amplitude adjusted left and right noisy and/or processed versions $y_l(k,m)$ and $y_r(k,m)$ of the left and right target signals from each other, and providing a resulting noisy and/or processed signal y(k,m); and S6. providing a final binaural speech intelligibility predictor value SI measure is indicative of the listener's perception of said noisy and/or processed versions $y_l$, $y_r$ of the target signal based on said resulting noise-free signal x(k,m) and said resulting noisy and/or processed signal y(k,m);

S7. Repeating steps S4-S6 to optimize the final binaural speech intelligibility predictor value, SI measure, to indicate a maximum intelligibility of said noisy and/or processed versions $y_l$ $y_r$ of the target signal by said listener.

It is intended that some or all of the structural features of the system described above, in the 'detailed description of embodiments' or in the claims can be combined with embodiments of the method, when appropriately substituted by a corresponding process and vice versa. Embodiments of the method have the same advantages as the corresponding systems.

In an embodiment, steps S4 and S5 each comprises providing that the relative time shift and amplitude adjustment is given by the factor:

$$\lambda=10^{(\gamma+\Delta\gamma)/40}e^{j\omega(\tau+\Delta\tau)/2}$$

where τ denoted time shift in seconds and γ denotes amplitude adjustment in dB, and where Δτ and Δγ are uncorrelated noise sources which model imperfections of the human auditory system of a normally hearing person, and where the resulting noise-free signal x(k,m) and the resulting noisy and/or processed signal y(k,m) is given by:

$$x_{k,m}=\lambda x_{k,m}^{(l)}-\lambda^{-1}x_{k,m}^{(r)},$$

and $$y_{k,m}=\lambda y_{k,m}^{(l)}-\lambda^{-1}y_{k,m}^{(r)},$$

respectively.

In an embodiment, the uncorrelated noise sources, Δτ and Δγ, are normally distributed with zero mean and standard deviation $$\sigma_{\Delta\gamma}(\gamma)=\sqrt{2}\cdot 1.5\text{ dB}\cdot\left(1+\left(\frac{|\gamma|}{13\text{ dB}}\right)^{1.6}\right)\text{ [dB]}$$

$$\sigma_{\Delta\gamma}(\gamma)=\sqrt{2}\cdot 65\cdot 10^{-6}s\cdot\left(1+\frac{|\tau|}{0.0016\ s}\right)\ [s]$$

and where the values γ and τ are determined such as to maximize the intelligibility predictor value.

In an embodiment, step S6 comprises providing a time-frequency sub-band representation of the resulting noise-free signal x(k,m) in the form of temporal envelopes, or functions thereof, of said resulting noise-free signal providing time-frequency sub-band signals X(q,m), q being a frequency sub-band index, q=1, 2, . . . , Q, and m being the time index;

providing a time-frequency sub-band representation of the resulting noisy and/or processed signal y(k,m) in the form of temporal envelopes, or functions thereof, of said resulting noisy and/or processed signal providing time-frequency sub-band signals Y(q,m), q being a frequency sub-band index, q=1, 2, . . . , Q, and m being the time index;

dividing said time-frequency sub-band representation X(q,m) of the resulting noise-free signal x(k,m) into time-frequency envelope segments x(q,m) corresponding to a number N of successive samples of said sub-band signals;

dividing said time-frequency sub-band representation Y(q,m) of the noisy and/or processed signal y(k,m) into time-frequency envelope segments y(q,m) corresponding to a number N of successive samples of said sub-band signals;

computing a correlation coefficient ρ(q,m) between each time frequency envelope segment of the noise-free signal and the corresponding envelope segment of the noisy and/or processed signal;

providing a final binaural speech intelligibility predictor value SI measure as a weighted combination of the computed correlation coefficients across time frames and frequency sub-bands.

In an embodiment, time-frequency signals X(q,m), X(q,m), q being a frequency sub-band index, q=1, 2, . . . , Q, representing temporal envelopes of the respective $q^{th}$ sub-band signals are power envelopes determined as $$X_{q,m}=\sum_{k=k_1(q)}^{k_2(q)}|y_{k,m}|^2$$

and $$Y_{q,m}=\sum_{k=k_1(q)}^{k_2(q)}|y_{k,m}|^2$$

respectively, where $k_1(q)$ and $k_2(q)$ denote lower and upper DFT-bins for the $q^{th}$ band, respectively. In an embodiment, the time-frequency-decomposition of time variant (noise-free or noisy) input signals is based on Discrete Fourier Transformation (DFT), converting corresponding time-domain signals to a time-frequency representation comprising (real or) complex values of magnitude and/or phase of the respective signals in a number of DFT-bins. In an embodiment, In the present application, a number Q of (non-uniform) frequency sub-bands with sub-band indices q=1, 2, . . . , J is defined, each sub-band comprising one or more DFT-bins (cf. vertical Sub-band q-axis in FIG. 3B). The $q^{th}$ sub-band comprises DFT-bins with lower and upper indices k1(q) and k2(q), respectively, defining lower and upper cut-off frequencies of the $q^{th}$ sub-band, respectively. In an embodiment, the frequency sub-bands are third octave bands. In an embodiment, the number of frequency sub-bands Q is 15.

In an embodiment, the power envelopes are arranged into vectors of N samples $$x_{q,m}=[X_{q,m-N+1},X_{q,m-N+2},\ldots,X_{q,m}]^T \text{ and}$$

$$y_{q,m}=[Y_{q,m-N+1},Y_{q,m-N+2},\ldots,Y_{q,m}]^T$$

where vectors $x_{q,m}$ and $y_{q,m}\in\mathbb{R}^{N\times 1}$. In an embodiment, N=30 samples.

In an embodiment, the correlation coefficient between clean and noisy/processed envelopes are determined as:

$$\rho_q=\frac{E[(X_{q,m}-E[X_{q,m}])(Y_{q,m}-E[Y_{q,m}])]}{\sqrt{E[(X_{q,m}-E[X_{q,m}])^2]E[(Y_{q,m}-E[Y_{q,m}])^2]}},$$

where the expectation is taken across both input signals and the noise sources $\Delta\tau$ and $\Delta\gamma$.

In an embodiment, an N-sample estimate $\hat{\rho}_{q,m}$ of the correlation coefficient $\rho_q$ across the input signals is then given by:

$$\hat{\rho}_{q,m}=\frac{E_\Delta\left[\left(x_{q,m}-1\mu_{x_{q,m}}\right)^T\left(y_{q,m}-1\mu_{y_{q,m}}\right)\right]}{\sqrt{E_\Delta\left[\|x_{q,m}-1\mu_{x_{q,m}}\|^2\right]E_\Delta\left[\|y_{q,m}-1\mu_{y_{q,m}}\|^2\right]}}, \quad (9)$$

where $\mu(\cdot)$ denotes the mean of the entries in the given vector, $E_\Delta$ is the expectation across the noise applied in steps S4, S4 and 1 is the vector of all ones.

In an embodiment, the final binaural speech intelligibility predictor value is obtained by estimating the correlation coefficients, $\hat{\rho}_{q,m}$, for all frames, m, and frequency bands, q, in the signal and averaging across these:

$$DBSTOI=\frac{1}{QM}\sum_{q=1}^{Q}\sum_{m=1}^{M}\hat{\rho}_{q,m},$$

where Q and M is the number of frequency sub-bands and the number of frames, respectively.

An Intrusive Binaural Speech Intelligibility Unit Configured to Implement the Method of Providing a Binaural Speech Intelligibility Predictor Value:

In an aspect, an intrusive binaural speech intelligibility unit configured to implement the method of providing a binaural speech intelligibility predictor value (as described above in the detailed description of embodiments and in the claims) is furthermore provided by the present disclosure.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. DISK and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Computer Program:

A computer program (product) comprising instructions which, when the program is executed by a computer, cause the computer to carry out (steps of) the method described above, in the 'detailed description of embodiments' and in the claims is furthermore provided by the present application.

Definitions

In the present context, a 'hearing aid' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing aid' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing aid may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing aid may comprise a single unit or several units communicating electronically with each other.

More generally, a hearing aid comprises an input transducer for receiving an acoustic signal from a user's surroundings and providing a corresponding input audio signal and/or a receiver for electronically (i.e. wired or wirelessly)

receiving an input audio signal, a (typically configurable) signal processing circuit for processing the input audio signal and an output means for providing an audible signal to the user in dependence on the processed audio signal. In some hearing aids, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing aid and/or for storing information (e.g. processed information, e.g. provided by the signal processing circuit), e.g. for use in connection with an interface to a user and/or an interface to a programming device. In some hearing aids, the output means may comprise an output transducer, such as e.g. a loudspeaker for providing an air-borne acoustic signal or a vibrator for providing a structure-borne or liquid-borne acoustic signal. In some hearing aids, the output means may comprise one or more output electrodes for providing electric signals.

In some hearing aids, the vibrator may be adapted to provide a structure-borne acoustic signal transcutaneously or percutaneously to the skull bone. In some hearing aids, the vibrator may be implanted in the middle ear and/or in the inner ear. In some hearing aids, the vibrator may be adapted to provide a structure-borne acoustic signal to a middle-ear bone and/or to the cochlea. In some hearing aids, the vibrator may be adapted to provide a liquid-borne acoustic signal to the cochlear liquid, e.g. through the oval window. In some hearing aids, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing aids, and a 'binaural hearing system' refers to a system comprising two hearing aids and being adapted to cooperatively provide audible signals to both of the user's ears. Hearing systems or binaural hearing systems may further comprise one or more 'auxiliary devices', which communicate with the hearing aid(s) and affect and/or benefit from the function of the hearing aid(s). Auxiliary devices may be e.g. remote controls, audio gateway devices, mobile phones (e.g. SmartPhones), public-address systems, car audio systems or music players. Hearing aids, hearing systems or binaural hearing systems may e.g. be used for compensating for a hearing-impaired person's loss of hearing capability, augmenting or protecting a normal-hearing person's hearing capability and/or conveying electronic audio signals to a person.

Embodiments of the disclosure may e.g. be useful in applications such as hearing instruments, headsets, ear phones, active ear protection systems, or combinations thereof or in development systems for such devices.

A time frequency representation of time variant signal x(n) may in the present disclosure be denoted x(k,m), or alternatively $x_{k,m}$ or alternatively $x_k(m)$, without any intended difference in meaning, where k denotes frequency and n and m denote time, respectively.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1A:
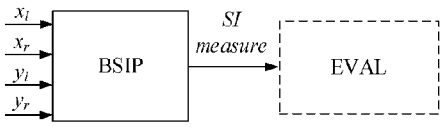
FIG. 1A symbolically shows a binaural speech intelligibility prediction system in combination with an evaluation unit.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids, in particular to speech intelligibility prediction. The topic of Speech Intelligibility Prediction (SIP) has been widely investigated since the introduction of the Articulation Index (AI) [French & Steinberg; 1947], which was later refined and standardized as the Speech Intelligibility Index (SII) [ANSI S3.5-1997]. While the research interest initially came from the telephone industry, the possible application to hearing aids and cochlear implants has recently gained attention, see e.g. [Taal et al.; 2012] and [Falk et al.; 2015].

The SII predicts monaural intelligibility in conditions with additive, stationary noise. Another early and highly popular method is the Speech Transmission Index (STI), which predicts the intelligibility of speech, which has been transmitted through a noisy and distorting transmission system (e.g. a reverberant room). Many additional SIP methods have been proposed, mainly with the purpose of extending the range of conditions under which predictions can be made.

For SIP methods to be applicable in relation to binaural communication devices such as hearing aids, the operating range of the classical methods must be expanded in two ways. Firstly, they must be able to take into account the non-linear processing that typically happens in such devices. This task is complicated by the fact that many SIP methods assume knowledge of the clean speech and interferer in separation; an assumption which is not meaningful when the combination of speech and noise has been processed non-linearly. One example of a method which does not make this assumption, is the STOI measure [Taal et al.; 2011] which predicts intelligibility from a noisy/processed signal and a clean speech signal. The STOI measure has been shown to predict well the influence on intelligibility of multiple enhancement algorithms. Secondly, SIP methods must take into account the fact that signals are commonly presented binaurally to the user. Binaural auditory perception provides the user with different degrees of advantage, depending on the acoustical conditions and the applied processing [Bronkhorst; 2000]. Several SIP methods have focused on predicting this advantage. Existing binaural methods, however, can generally not provide predictions for non-linearly processed signals.

A setup of a binaural intrusive speech intelligibility predictor unit BSIP in combination with an evaluation unit EVAL is illustrated in FIG. 1A. The binaural intrusive speech intelligibility predictor unit provides speech intelligibility measure (SI measure in FIG. 1A) based on (at least) four signals comprising noisy/processed signals ($y_l$, $y_r$) as presented to the left and right ears of the listener and clean speech signals ($x_l$, $x_r$), also as presented to the left and right ears of the listener. The clean speech signal should preferably be the same as the noisy/processed one, but without noise and without processing (e.g. in a hearing aid)). The evaluation unit (EVAL) is shown to receive and evaluate the binaural speech intelligibility predictor SI measure. The evaluation unit (EVAL) may e.g. further process the speech intelligibility predictor value SI measure, to e.g. graphically and/or numerically display the current and/or recent historic values, derive trends, etc. The evaluation unit may e.g. be implemented in a separate device, e.g. acting as a user interface to the binaural speech intelligibility prediction unit (BSIP), e.g. forming part of a test system (see e.g. FIG. 5) and/or to a hearing aid including such unit, e.g. implemented as a remote control device, e.g. as an APP of a smartphone.

The clean (target) speech signals ($x_l$, $x_r$) as presented to the left and right ears of the listener from a given acoustic (target) source in the environment of the listener (at a given location relative to the user) may be generated from an acoustic model of the setup including measured or modelled head related transfer functions (HRTF) to provide appropriate frequency and angle dependent interaural time (ITD) and level differences (ILD). The contributions ($n_{i,l}$, $n_{i,r}$) as presented to the left and right ears of the listener of individual noise sources $N_i$, i=1, 2, . . . , $N_s$, $N_s$ being the number of noise sources considered (e.g. equal to one or more), located at different positions around the listener may likewise be determined from an acoustic model of the setup. Thereby, noisy (e.g. un-processed) signals ($y_l$, $y_r$) comprising the target speech as presented to the left and right ears of the listener may be provided as the sum of the respective clean (target) speech signals ($x_l$, $x_r$) and the noise signals ($n_{i,l}$, $n_{i,r}$) of individual noise sources $N_i$, i=1, 2, . . . , $N_s$, as presented to the left and right ears of the listener (cf. e.g. FIG. 4).

Figure 4:
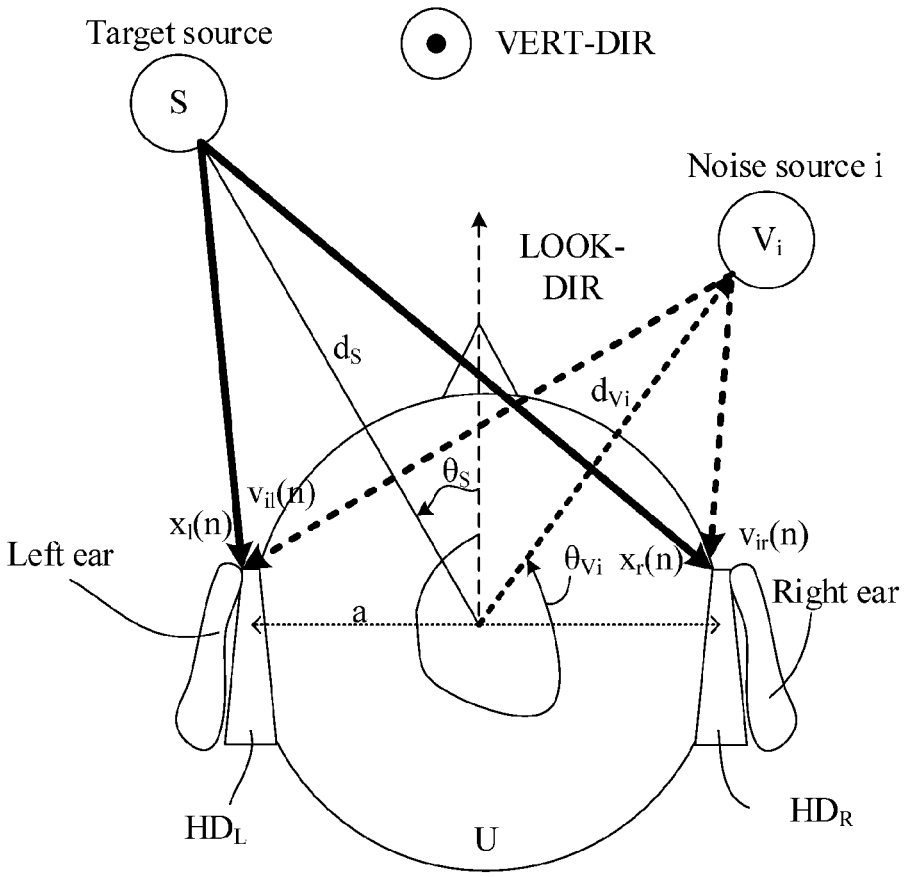
FIG. 4 shows a listening test scenario comprising a user, a target signal source and one or more noise sources located around the user.

Alternatively, the clean (target) speech signals ($x_l$, $x_r$) and noisy (e.g. un-processed) signals ($y_l$, $y_r$) as presented to the left and right ears of a listener may be measured in a specific geometric setup, e.g. using a dummy head model (e.g. performed in a sound studio with a head-and-torso-simulator (HATS, Head and Torso Simulator 4128C from Brüel & Kjær Sound & Vibration Measurement A/S)) (cf. e.g. FIG. 4).

Hence, in an embodiment, the clean and noisy signals as presented to the left and right ears of the listener and used as inputs to the binaural speech intelligibility predictor unit are provided as artificially generated and/or measured signals.

Figure 1B:
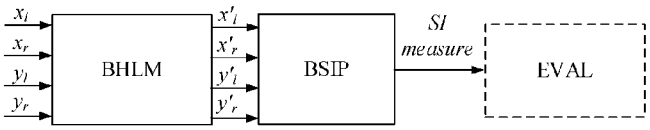
FIG. 1B shows a binaural speech intelligibility prediction system in combination with a binaural hearing loss model and an evaluation unit.

FIG. 1B shows a binaural speech intelligibility prediction system in combination with a binaural hearing loss model (BHLM) and an evaluation unit (EVAL). The hearing loss model (Hearing loss model, BHLM) is e.g. configured to reflect a user's hearing loss (i.e. to distort (modify) acoustic inputs, here noisy signals ($y_l$, $y_r$) as the use's auditory system would).

Figure 1C:
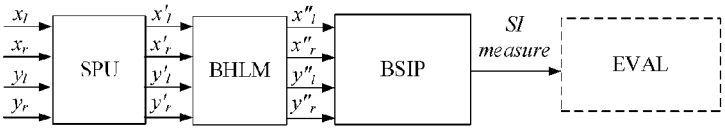
FIG. 1C shows a combination of a binaural speech intelligibility prediction system with a binaural hearing loss model, a signal processing unit and an evaluation unit.

FIG. 1C shows a combination of a binaural speech intelligibility prediction system with a binaural hearing loss model (BHLM), a signal processing unit (SPU) and an evaluation unit (EVAL). The signal processing unit (SPU) may e.g. be configured to run one or more processing algorithms of a hearing aid. Such configuration may thus be used to simulate a listening test for trying out a particular signal processing algorithm, e.g. during development of the algorithm, of to find appropriate settings of the algorithm for a given user.

Figure 1D:
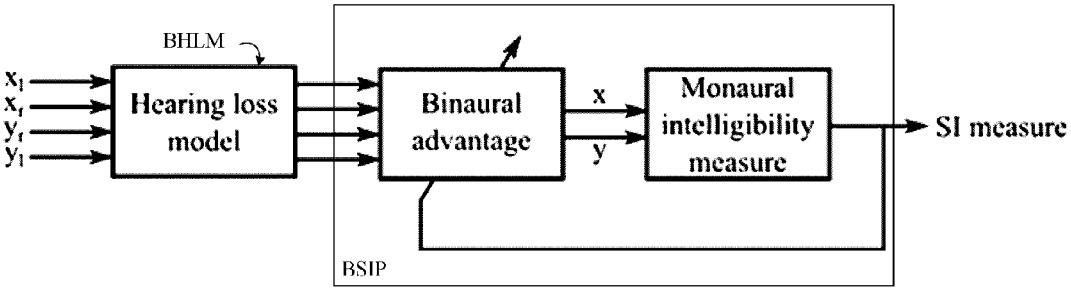
FIG. 1D shows a block diagram of the proposed speech intelligibility prediction method.

FIG. 1D shows a block diagram of a binaural speech intelligibility prediction system comprising a binaural speech intelligibility prediction unit (BSIP) and a binaural hearing loss model (BHLM). The binaural speech intelligibility prediction unit shown in FIG. 1D comprises the blocks Binaural advantage and Monaural intelligibility measure. The Binaural advantage block comprises a model having one or more parameters, which determine how the left and right ear signals are combined by the auditory system. The Monaural intelligibility measure comprises a monaural speech intelligibility prediction unit, e.g. as described in [Taal et al.; 2011]

Figure 2A:
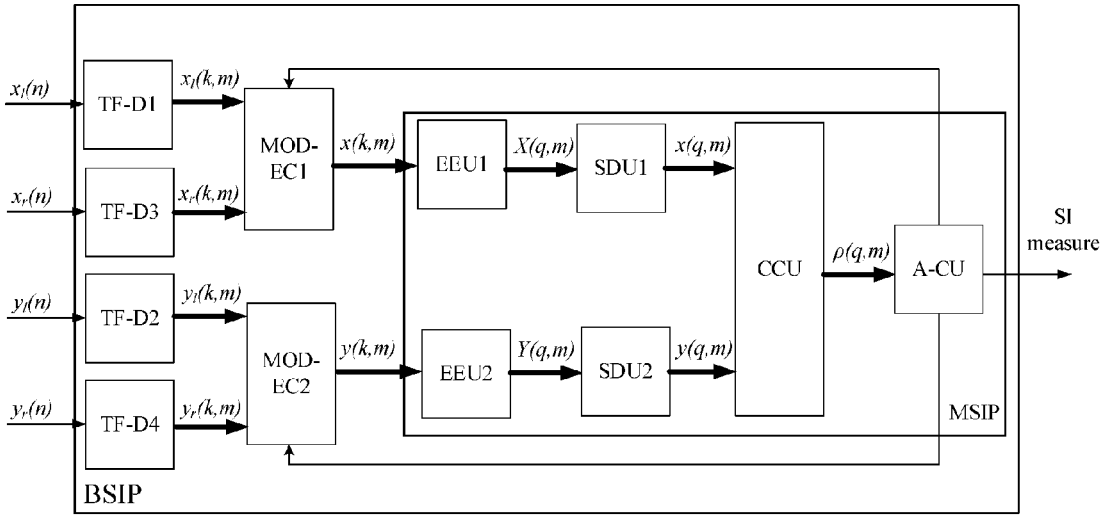
FIG. 2A shows a general embodiment of a binaural speech intelligibility prediction unit according to the present disclosure.
Figure 2B:
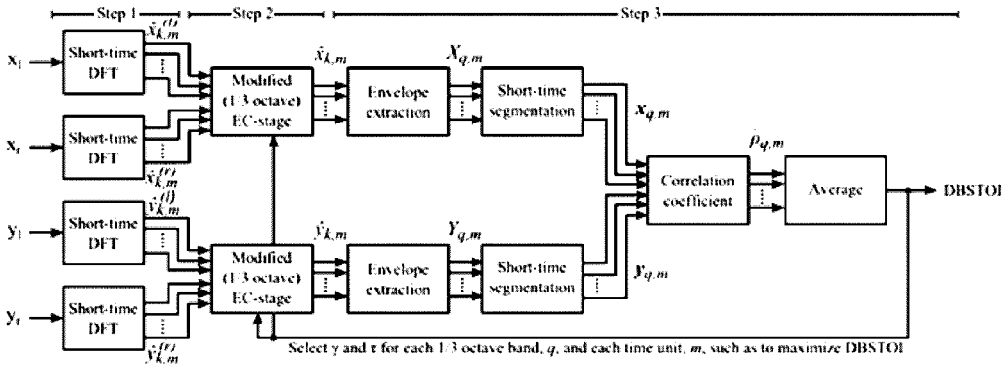
FIG. 2B shows a block diagram of an embodiment of the method for providing the DBSTOI speech intelligibility measure according to the present disclosure, FIG. 3A schematically shows a time variant analogue signal (Amplitude vs time) and its digitization in samples, the samples being arranged in a number of time frames, each comprising a number $N_s$ of samples.

The exemplary measure as shown in FIG. 2A, 2B does NOT include the block Hearing loss model in FIG. 1D.

FIG. 2A shows a general embodiment of a binaural speech intelligibility prediction unit according to the present disclosure. FIG. 2A shows an intrusive binaural speech intelligibility prediction system comprising a binaural speech intelligibility predictor unit (BSIP) adapted for receiving a target signal comprising speech in a) left and right essentially noise-free versions ($x_l$, $x_r$) and in b) left and right noisy and/or processed versions ($y_l$, $y_r$). The clean ($x_l$, $x_r$) and noisy/processed ($y_l$, $y_r$) signals are representative of acoustic signals as received at left and right ears of a listener. The binaural speech intelligibility predictor unit (BSIP) is configured to provide as an output a final binaural speech intelligibility predictor value SI measure indicative of the listener's perception of the noisy and/or processed versions $y_l$, $y_r$ of the target signal. The binaural speech intelligibility predictor unit (BSIP) comprises first and third input units (TF-D1, TF-D3) for providing time-frequency representations $x_l(k,m)$ and $x_r(k,m)$ of said left and right noise-free versions $x_l(n)$ and $x_r(n)$, respectively, of the target signal, k being a frequency bin index, k=1, 2, . . . , K, m and n being a time indices. The binaural speech intelligibility predictor unit (BSIP) further comprises second and fourth input units (TF-D2, TF-D4) for providing time-frequency representations $y_l(k,m)$ and $y_r(k,m)$ of said left and right noisy and/or processed versions $y_l(n)$ and $y_r(n)$ of the target signal, respectively. The binaural speech intelligibility predictor unit (BSIP) further comprises a first equalization-cancellation stage (MOD-EC1) adapted to receive and relatively time shift and amplitude adjust the left and right time-frequency representations of the noise-free versions $x_l(k,m)$ and $x_r(k,m)$, respectively, and to subsequently subtract the time shifted and amplitude adjusted left and right noise-free versions $x'_l(k,m)$ and $x'_r(k,m)$ of the left and right signals from each other, and to provide a resulting noise-free signal x(k,m). The binaural speech intelligibility predictor unit (BSIP) further comprises a second equalization-cancellation stage (MOD-EC2) adapted to receive and relatively time shift and amplitude adjust the left and right time-frequency representations of the noisy and/or processed versions $y_l(k,m)$ and $y_r(k,m)$, respectively, and to subsequently subtract the time shifted and amplitude adjusted left and right noisy and/or processed versions $y'_l(k,m)$ and $y'_r(k,m)$ of the left and right signals from each other, and to provide a resulting noisy and/or processed signal y(k,m). The binaural speech intelligibility predictor unit (BSIP) further comprises a monaural speech intelligibility predictor unit (MSIP) for providing the final binaural speech intelligibility predictor value SI measure based on the resulting noise-free signal x(k,m) and the resulting noisy and/or processed signal y(k,m). The first and second equalization-cancellation stages (MOD-EC1, MOD-EC2) are adapted to optimize the final binaural speech intelligibility predictor value SI measure to provide a maximum (estimated) intelligibility (of the listener) of the noisy and/or processed versions $y_l$, $y_r$ of the target signal.

In the embodiment of an intrusive binaural speech intelligibility prediction system shown in FIG. 2A, the monaural speech intelligibility predictor unit (MSIP) comprises a first envelope extraction unit (EEU1) for providing a time-frequency sub-band representation of the resulting noise-free signal x(k,m) in the form of temporal envelopes, or functions thereof, of the resulting noise-free signal providing time-frequency sub-band signals X(q,m), where q is a frequency sub-band index, q=1, 2, . . . , Q, and m is the time index. The monaural speech intelligibility predictor unit (MSIP) further comprises a second envelope extraction unit (EEU2) for providing a time-frequency sub-band representation of the resulting noisy and/or processed signal y(k,m) in the form of temporal envelopes, or functions thereof, of the resulting noisy and/or processed signal providing time-frequency sub-band signals Y(q,m). The monaural speech intelligibility predictor unit (MSIP) further comprises a first time-frequency segment division unit (SDU1) for dividing the time-frequency sub-band representation X(q,m) of the resulting noise-free signal x(k,m) into time-frequency envelope segments x(q,m) corresponding to a number N of successive samples of the sub-band signals. Likewise, the monaural speech intelligibility predictor unit (MSIP) further comprises a second time-frequency segment division unit (SDU2) for dividing the time-frequency sub-band representation Y(q,m) of the noisy and/or processed signal y(k,m) into time-frequency envelope segments y(q,m) corresponding to a number N of successive samples of the sub-band signals. The monaural speech intelligibility predictor unit (MSIP) further comprises a correlation coefficient unit (CCU) adapted to compute a correlation coefficient $\hat{\rho}(q, m)$ between each time frequency envelope segment of the noise-free signal and the corresponding envelope segment of the noisy and/or processed signal. The monaural speech intelligibility predictor unit (MSIP) further comprises a final speech intelligibility measure unit (A-CU) providing a final binaural speech intelligibility predictor value SI measure as a weighted combination of the computed correlation coefficients across time frames and frequency sub-bands. Optimization of the final binaural speech intelligibility predictor value SI measure to provide a maximum (estimated) intelligibility (of the listener) of the noisy and/or processed versions $y_l$, $y_r$ of the target signal is indicated by connections from the final speech intelligibility measure unit (A-CU) to the first and second equalization-cancellation stages (MOD-EC1, MOD-EC2), respectively. An example of such optimization process is described in connection with section Step 2: EC Processing below.

FIG. 2B shows a block diagram of a method of/device for providing the DBSTOI binaural speech intelligibility measure.

In [Andersen et al.; 2015], a binaural extension of the STOI measure—the Binaural STOI (BSTOI) measure—was proposed. The BSTOI measure has been shown to predict well the intelligibility (including binaural advantage) obtained in conditions with a frontal target and a single point noise source in the horizontal plane. The BSTOI measure was also shown to predict the intelligibility of diotic speech which had been processed by ITFS (Ideal Time Frequency Segregation).

In the present application an improved version of the BSTOI measure is presented, which is computationally less demanding and, unlike BSTOI, produces deterministic results. The proposed measure has the advantage of being able to predict intelligibility in conditions where both binaural advantage and non-linear processing simultaneously influence intelligibility. To the knowledge of the present inventors, no other SIP method is capable of producing predictions in conditions where intelligibility is affected by both. We refer to the improved binaural speech intelligibility measure as the Deterministic BSTOI (DBSTOI) measure.

The DBSTOI measure scores intelligibility based on four signals: The noisy/processed signal as presented to the left and right ears of the listener and a clean speech signal, also at both ears. The clean (essentially noise-free) signal should be the same as the noisy/processed one, but with neither noise nor processing. The DBSTOI measure produces a score in the range 0 to 1. The aim is to have a monotonic correspondence between the DBSTOI measure and measured intelligibility, such that a higher DBSTOI measure corresponds to a higher intelligibility (e.g. percentage of words heard correctly).

The DBSTOI measure is based on combining a modified Equalization Cancellation (EC) stage with the STOI measure as proposed in [Andersen et al.; 2015]. Here, we introduce further structural changes in the STOI measure to allow for better integration with the EC-stage. This allows for computing the measure deterministically and in closed form, contrary to the BSTOI measure [Andersen et al.; 2015], which is computed using Monte Carlo simulation.

The structure of the DBSTOI measure is shown in FIG. 2B. The procedure is separated in three main steps: 1) a time-frequency-decomposition based on the Discrete Fourier Transformation (DFT), 2) a modified EC stage which extracts binaural advantage and 3) a modified version of the monaural STOI measure.

Specific Example:

As a specific example of the proposed type of binaural intelligibility predictor, the DBSTOI measure as described in the following. A block diagram of the binaural speech intelligibility prediction unit providing this specific measure is shown in FIG. 2B. The measure/unit corresponds to the blocks Binaural advantage and Monaural intelligibility measure in FIG. 1D. The exemplary measure as shown in FIG. 2B does NOT include the block Hearing loss model shown in FIGS. 1B, 1C, and 1D.

An outline of the procedure of computing the DBSTOI measure is given by:

1) The input signals are time-frequency decomposed by use of a short time Fourier transformation. Subsequent steps are carried out in the short-time Fourier domain.
2) The left and right ear signals are combined by means of a modified equalization stage.
   Specifically:
   a. The left and right ear signals are time shifted and amplitude adjusted relative to each other. This is done separately for a range of third octave bands. See equations (1) and (2) below.
   b. The time shifted and amplitude adjusted left and right signals are subtracted from one-another. This difference is referred to as the combined signal. The same time shifts and amplitude adjustment factors are applied for the clean signals and the noisy/processed signals. One combined clean signal and one combined noisy/processed signal is obtained in this manner. See equations (1) and (2) below.
3) A power envelope is extracted from each third octave band for each signal (the clean and the noisy/processed one). See equation (5) below.
4) The envelopes are arranged into short overlapping segments. See equation (8) below.
5) The correlation coefficient is computed between each envelope segment of the clean signal and the corresponding envelope segment of the noisy/processed signal. See equation (9) below.
6) The final measure is obtained as an average of the computed correlation coefficients across all time frames and third octave bands. See equation (15) below.

Advantageously, the time shift and amplitude adjustment factors in step 2 are determined independently for each short envelope segment and are determined such as to maximize the correlation between the envelopes. This corresponds to the assumption that the human brain uses the information from both ears such as to make speech as intelligible as is possible. The final number typically lies in the interval between 0 to 1, where 0 indicates that the noisy/processed signal is much unlike the clean signal and should be expected to be unintelligible, while numbers close to 1 indicate that the noisy/processed signal is close to the clean signal and should be expected to be highly intelligible.

Step 1: TF Decomposition

The first step (cf. e.g. Step 1 in FIG. 2B) resamples the four input signals $x_l$, $y_r$, $y_l$, $y_r$ to 10 kHz, removes segments with no speech (via an ideal frame based voice activity detector) and performs a short-time DFT-based Time Frequency (TF) decomposition (cf. blocks Short-time DFT in FIG. 2B). This is done in exactly the same manner as for the STOI measure (cf. e.g. [Taal et al.; 2011]). Let $x_{k,m}^{(l)} \in \mathbb{C}$ be the TF unit corresponding to the clean signal at the left ear in the $m^{th}$ time frame and the $k^{th}$ frequency bin (cf. FIG. 3B). Similarly, let $x_{k,m}^{(r)}$, $y_{k,m}^{(l)}$ and $y_{k,m}^{(r)}$ denote the right ear clean signal, and the left and right ear noisy/processed signal TF units, respectively.

Step 2: EC Processing

The second step (cf. e.g. Step 2 in FIG. 2B) of computing the measure combines the left and right ear signals using a modified EC stage (EC=Equalization-Cancellation) to model binaural advantage (cf. e.g. [Durlach; 1963], [Durlach; 1972]) (cf. blocks Modified (⅓ octave) EC-stage in FIG. 2B).

A combined clean signal is obtained by relatively time shifting and amplitude adjusting the left and right clean signals and thereafter subtracting one from the other. The same is done for the noisy/processed signals to obtain a single noisy/processed signal. The relative time shift of $\tau$ (seconds) and amplitude adjustment of $\gamma$ (dB) is given by the factor:

$$\lambda = 10^{(\gamma+\Delta\gamma)/40} e^{j\omega(\tau+\Delta\tau)/2} \tag{1}$$

where $\Delta\tau$ and $\Delta\gamma$ are uncorrelated noise sources which model imperfections of the human auditory system of a normally hearing person. The resulting combined clean signal is given by:

$$x_{k,m} = \lambda x_{k,m}^{(l)} - \lambda^{-1} x_{k,m}^{(r)} \tag{2}$$

A combined noisy/processed TF-unit, $y_{k,m}$, is obtained in a similar manner (using the same value of $\lambda$).

The uncorrelated noise sources, $\Delta\tau$ and $\Delta\gamma$, are normally distributed with zero mean and standard deviation:

$$\sigma_{\Delta\gamma}(\gamma) = \sqrt{2}\cdot 1.5\ \text{dB}\cdot\left(1+\left(\frac{|\gamma|}{13\ \text{dB}}\right)^{1.6}\right)\ [\text{dB}] \tag{3}$$

$$\sigma_{\Delta\gamma}(\gamma) = \sqrt{2}\cdot 65\cdot 10^{-6}s\cdot\left(1+\frac{|\tau|}{0.0016\ s}\right)\ [s] \tag{4}$$

Following the principle introduced in [Andersen et al.; 2015], the values $\gamma$ and $\tau$ are determined such as to maximize the scoring of intelligibility. This is further described below.

Step 3: Intelligibility Prediction

At this point the four input signals have been condensed to two signals: a clean signal, $x_{k,m}$, and a noisy/processed signal, $y_{k,m}$. We compute an intelligibility score for these signals by use of a variation of the STOI measure. For mathematical tractability, we use power envelopes rather than magnitude envelopes as originally proposed in STOI [Taal et al.; 2011]. This is also done in [Taal et al.; 2012] and appears not to have a significant effect on predictions. Furthermore, we discard the clipping mechanism contained in the original STOI, as also done in [Taal et al.; 2012]. We have seen no indication that this negatively influences results.

The clean and processed signal power envelope is determined in Q=15 third octave bands (cf. blocks Envelope extraction in FIG. 2B):

$$X_{q,m} = \sum_{k=k_1(q)}^{k_2(q)} |x_{k,m}|^2 \approx \propto X_{q,m}^{(l)} + \propto^{-1} X_{q,m}^{(r)} - 2\text{Re}[e^{-j\omega_q(\tau+\Delta\tau)}X_{q,m}^{(c)}] \tag{5}$$

where $\alpha=10^{(\gamma+\Delta\gamma)/20}$ and:

$$X_{q,m}^{(l)/(r)}=\sum_{k=k_1(q)}^{k_2(q)}|x_{k,m}^{(l)/(r)}|^2, X_{q,m}^{(c)}=\sum_{k=k_1(q)}^{k_2(q)} x_{k,m}^{(l)} * x_{k,m}^{(r)} \tag{6}$$

where superscript c indicates the correlation between the left and right channels and where $k_1(q)$ and $k_2(q)$ denote the lower and upper DFT bins for the $q^{th}$ third octave band, respectively, and $\omega_q$ is the center frequency of the $q^{th}$ frequency band. The approximate equality is obtained by inserting (1) and (2) and assuming that the energy in each third octave band is contained at the center frequency. A similar procedure for the processed signal yields third octave power envelopes, $Y_{q,m}$.

If we assume that the input signals are wide sense stationary stochastic processes, the power envelopes, $X_{q,m}$ and $Y_{q,m}$ are also stochastic processes, due to the stochastic nature of the input signals as well as the noise sources, $\Delta\tau$ and $\Delta\gamma$, in the EC stage. An underlying assumption of STOI is that intelligibility is related to the correlation between clean and noisy/processed envelopes (cf. e.g. [Taal et al.; 2011]):

$$\rho_q = \frac{E[(X_{q,m}-E[X_{q,m}])(Y_{q,m}-E[Y_{q,m}])]}{\sqrt{E[(X_{q,m}-E[X_{q,m}])^2]E[(Y_{q,m}-E[Y_{q,m}])^2]}}, \tag{7}$$

where the expectation is taken across both input signals and the noise sources in the EC stage.

To estimate $\rho_g$, the power envelopes are arranged into vectors of N=30 samples (cf. e.g. [Taal et al.; 2011] and blocks Short-time segmentation in FIG. 2B):

$$x_{q,m}=[X_{q,m-N+1}, X_{q,m-N+2}, \ldots, X_{q,m}]^T. \tag{8}$$

Similar vectors, $y_{q,m}\in\mathbb{R}^{N\times 1}$ are defined for the processed signal.

An N-sample estimate of $\rho_q$ across the input signals is then given by:

$$\hat{\rho}_{q,m} = \frac{E_\Delta[(x_{q,m}-1\mu_{x_{q,m}})^T(y_{q,m}-1\mu_{y_{q,m}})]}{\sqrt{E_\Delta[\|x_{q,m}-1\mu_{x_{q,m}}\|^2]E_\Delta[\|y_{q,m}-1\mu_{y_{q,m}}\|^2]}}, \tag{9}$$

where $\mu(\cdot)$ denotes the mean of the entries in the given vector, $E_\Delta$ is the expectation across the noise in the EC stage and 1 is the vector of all ones (cf. block Correlation coefficient in FIG. 2B). A closed form expression for this expectation can be derived, and is given by:

$$\begin{aligned}E_\Delta[(x_{q,m}-\mu_{x_{q,m}})^T(y_{q,m}-\mu_{y_{q,m}})] &= (e^{2\beta}l_{x_{q,m}}^T l_{y_{q,m}} + e^{-2\beta}r_{x_{q,m}}^T r_{y_{q,m}})e^{2\sigma\Delta\beta^2} + r_{x_{q,m}}^T l_{y_{q,m}} + l_{x_{q,m}}^T r_{y_{q,m}} - \\ &2e^{\sigma\Delta\beta^2/2}e^{-\omega^2\sigma\Delta\tau^2/2}\times\{(e^{\beta}l_{x_{q,m}}^T + e^{-\beta}r_{x_{q,m}}^T) \\ &Re[c_{y_{q,m}}e^{-j\omega\tau}]+Re[e^{-j\omega\tau}c_{x_{q,m}}]^T(e^{\beta}l_{y_{q,m}}+e^{-\beta}r_{y_{q,m}})\}+ \\ &2(Re[c_{x_{q,m}}c_{y_{q,m}}]+e^{-2\omega^2\sigma\Delta\tau^2}Re[c_{x_{q,m}}^T c_{y_{q,m}}e^{-j2\omega\tau}]),\end{aligned} \tag{10}$$

where $$l_{x_{q,m}} = [X_{q,m-N+1}^{(l)}, \ldots, X_{q,m}^{(l)}]^T - 1\sum_{k=m-N+1}^{m}\frac{X_{q,k}^{(l)}}{N}, \tag{11}$$

$$r_{x_{q,m}} = [X_{q,m-N+1}^{(r)}, \ldots, X_{q,m}^{(r)}]^T - 1\sum_{k=m-N+1}^{m}\frac{X_{q,k}^{(r)}}{N}, \tag{12}$$

$$c_{x_{q,m}} = [X_{q,m-N+1}^{(c)}, \ldots, X_{q,m}^{(c)}]^T - 1\sum_{k=m-N+1}^{m}\frac{X_{q,k}^{(c)}}{N}, \tag{13}$$

$$\beta = \frac{\ln(10)}{20}\gamma,\ \sigma_{\Delta\beta}^2 = \left(\frac{\ln(10)}{20}\right)^2\sigma_{\Delta\gamma}^2, \tag{14}$$

and similarly for the noisy/processed signal. An expression for $E_\Delta[\|x_{q,m}-\mu_{x_{q,m}}\|^2]$ may be obtained from (10) by replacing all instances of $y_{q,m}$ by $x_{q,m}$ and vice versa for $E_\Delta[\|y_{q,m}-\mu_{y_{q,m}}\|^2]$.

The final DBSTOI measure is obtained by estimating the correlation coefficients, $\hat{\rho}_{q,m}$, for all frames, m, and frequency bands, q, in the signal and averaging across these [Taal et al.; 2011];

$$DBSTOI = \frac{1}{QM}\sum_{q=1}^{Q}\sum_{m=1}^{M}\hat{\rho}_{q,m}, \tag{15}$$

where Q and M is the number of frequency bands and the number of frames, respectively (cf. block Average in FIG. 2B).

It can be shown that whenever the left and right ear inputs are identical, the DBSTOI measure produces scores which are identical those of the monaural STOI (that is, the modified monaural STOI measure based on (5) and without clipping).

Determination of $\gamma$ and $\tau$

Finally, we consider the parameters $\gamma$ and $\tau$. These parameters are determined individually for each time unit, m, and third octave band, q, such as to maximize the final DBSTOI measure (cf. feedback loop from output DBSTOI to blocks Modified (⅓ octave) EC-stage in FIG. 2B). Thus, each correlation coefficient estimate is a function of its own set of parameters, $\hat{\rho}_{q,m}(\gamma,\tau)$. The DBSTOI measure, (15), can therefore be maximized by maximizing each of the estimated correlation coefficients individually:

$$\hat{\rho}_{q,m}=\max_{\gamma\tau}\hat{\rho}_{q,m}(\gamma,\tau). \tag{16}$$

In general, the optimization may be carried out by evaluating $\hat{\rho}_{q,m}$ for a discrete set of $\gamma$ and $\tau$ values and choosing the highest value.

Figure 3A:
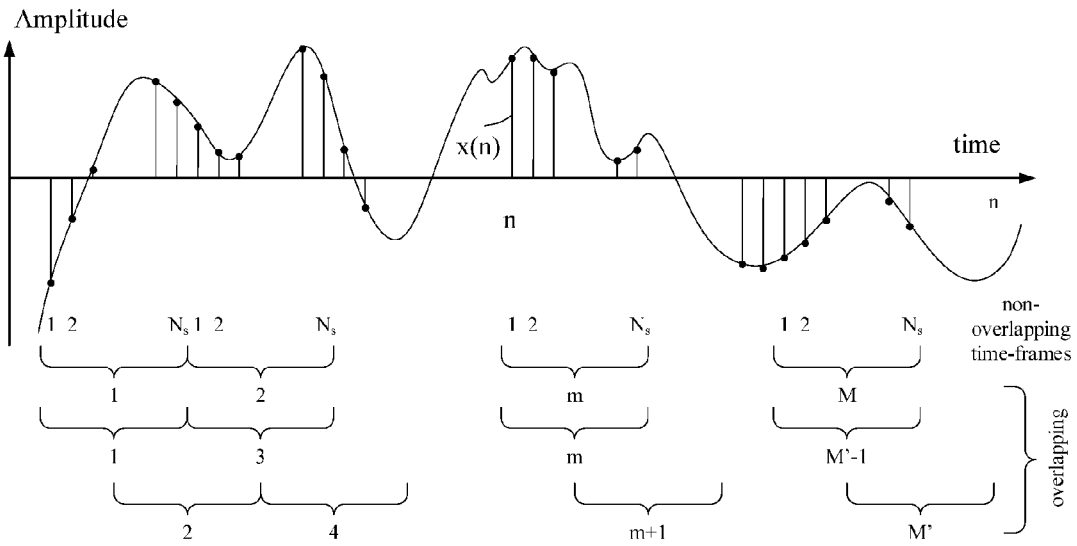
FIG. 3B illustrates a time-frequency map representation of the time variant electric signal of FIG. 3A.

FIG. 3A schematically shows a time variant analogue signal (Amplitude vs time) and its digitization in samples, the samples being arranged in a number of time frames, each comprising a number $N_s$ of digital samples. FIG. 3A shows an analogue electric signal (solid graph), e.g. representing an acoustic input signal, e.g. from a microphone, which is converted to a digital audio signal in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples x(n) at discrete points in time n, as indicated by the vertical lines extending from the time axis with solid dots at its endpoint coinciding with the graph, and representing its digital sample value at the corresponding distinct point in time n. Each (audio) sample x(n) represents the value of the acoustic signal at n by a predefined number $N_b$ of bits, $N_b$ being e.g. in the range from 1 to 16 bits. A digital sample x(n) has a length in time of $1/f_s$, e.g. 50 μs, for $f_s$=20 kHz. A number of (audio) samples $N_s$ are arranged in a time frame, as schematically illustrated in the lower part of FIG. 3A, where the individual (here uniformly spaced) samples are grouped in time frames (1, 2, . . . , $N_s$)). As also illustrated in the lower part of FIG. 3A, the time frames may be arranged consecutively to be non-overlapping (time frames 1, 2, . . . , m, . . . , M) or overlapping (here 50%, time frames 1, 2, . . . , m, . . . , M'), where m is time frame index. In an embodiment, a time frame comprises 64 audio data samples. Other frame lengths may be used depending on the practical application.

Figure 3B:
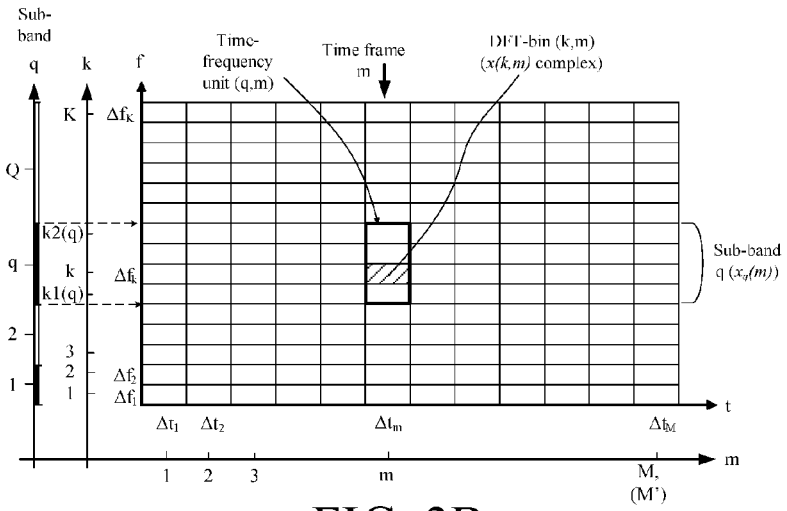

FIG. 3B schematically illustrates a time-frequency representation of the (digitized) time variant electric signal x(n) of FIG. 3A. The time-frequency representation comprises an array or map of corresponding complex or real values of the signal in a particular time and frequency range. The time-frequency representation may e.g. be a result of a Fourier transformation converting the time variant input signal x(n) to a (time variant) signal x(k,m) in the time-frequency domain. In an embodiment, the Fourier transformation comprises a discrete Fourier transform algorithm (DFT). The frequency range considered by a typical hearing aid (e.g. a hearing aid) from a minimum frequency $f_{min}$ to a maximum frequency $f_{max}$ comprises a part of the typical human audible frequency range from 20 Hz to 20 kHz, e.g. a part of the range from 20 Hz to 12 kHz. In FIG. 3B, the time-frequency representation x(k,m) of signal x(n) comprises complex values of magnitude and/or phase of the signal in a number of DFT-bins defined by indices (k,m), where k=1, . . . , K represents a number K of frequency values (cf. vertical k-axis in FIG. 3B) and m=1, . . . , M (M') represents a number M (M') of time frames (cf. horizontal m-axis in FIG. 3B). A time frame is defined by a specific time index m and the corresponding K DFT-bins (cf. indication of Time frame m in FIG. 3B). A time frame in represents a frequency spectrum of signal x at time m. A DFT-bin (k,m) comprising a (real) or complex value x(k,m) of the signal in question is illustrated in FIG. 3B by hatching of the corresponding field in the time-frequency map. Each value of the frequency index k corresponds to a frequency range $\Delta f_k$, as indicated in FIG. 3B by the vertical frequency axis f. Each value of the time index m represents a time frame. The time $\Delta t_m$ spanned by consecutive time indices depend on the length of a time frame (e.g. 25 ms) and the degree of overlap between neighbouring time frames (cf. horizontal t-axis in FIG. 3B).

In the present application, a number Q of (non-uniform) frequency sub-bands with sub-band indices q=1, 2, . . . , J is defined, each sub-band comprising one or more DFT-bins (cf. vertical Sub-band q-axis in FIG. 3B). The $q^{th}$ sub-band (indicated by Sub-band q ($x_q(m)$) in the right part of FIG. 3B) comprises DFT-bins with lower and upper indices k1(a) and k2(q), respectively, defining lower and upper cut-off frequencies of the $q^{th}$ sub-band, respectively. A specific time-frequency unit (q,m) is defined by a specific time index m and the DFT-bin indices k1(q)-k2(q), as indicated in FIG. 3B by the bold framing around the corresponding DFT-bins. A specific time-frequency unit (q,m) contains complex or real values of the $q^{th}$ sub-band signal $x_q(m)$ at time m. In an embodiment, the frequency sub-bands are third octave bands. $\omega_q$ denote a center frequency of the $q^{th}$ frequency band.

FIG. 4 shows a listening test scenario comprising a user, a target signal source and one or more noise sources located around the user.

FIG. 4 illustrates a user (U) wearing a hearing system comprising left and right hearing aids ($HD_L$, $HD_R$) located at left and right ears (Left ear, Right ear) of the user. A target signal source (Target source, 5) comprising noise free-speech and a number of noise sound sources (Noise source i, $V_i$, i=1, 2, . . . , $N_V$, where $N_V$ is the number of noise sound sources) located at well-defined points in space around the user. The location of the target sound source (S) relative to the user (the centre of the head of the user) is defined by vector $d_S$. The location of the noise sound source ($V_i$) relative to the user is defined by vector $d_{Vi}$. A direction (in a horizontal plane perpendicular to a vertical direction VERT-DIR) from a user to a given sound source is defined by an angle $\theta$ relative to a look direction (LOOK-DIR) of the user following the nose of the user. The direction to the target sound source (S) and the noise sound source ($V_i$) is defined by angle $\theta_S$ and $\theta_{Vi}$, respectively.

A target signal from target source S comprising speech (e.g. from a person or a loudspeaker) in left and right essentially noise-free (clean) target signals $x_l(n)$, $x_r(n)$, n being a time index, as received at the left and right hearing aids ($HD_L$, $HD_R$), respectively, when located at the left and right ears of the user can e.g. be recorded in a recording session, where each of the hearing aids comprise appropriate microphone and memory units. Likewise, a signal from a noise sound source $V_i$ can be recorded as received at the left and right hearing aids ($HD_L$, $HD_R$), respectively, providing noise signals $v_{il}(n)$, $v_{ir}(n)$. This can be performed for each of the sound sources $V_i$, i=1, 2, . . . , $N_V$. Left and right noisy and/or processed versions $y_l(n)$, $y_r(n)$ of the target signal can then be composed by mixing (addition) of the noise-free (clean) left and right target signals $x_l(n)$, $x_r(n)$, and the left and right noise signals $v_{il}(n)$, $v_{ir}(n)$, i=1, 2, . . . , $N_V$. In other words left and right noisy and/or processed versions $y_l(n)$, $y_r(n)$ of the target signal can be determined as $y_l(n)=x_l(n)+v_{il}(n)$, and $y_r(n)=x_r(n)+v_{ir}(n)$, i=1, 2, . . . , $N_V$, respectively.

Figure 7:
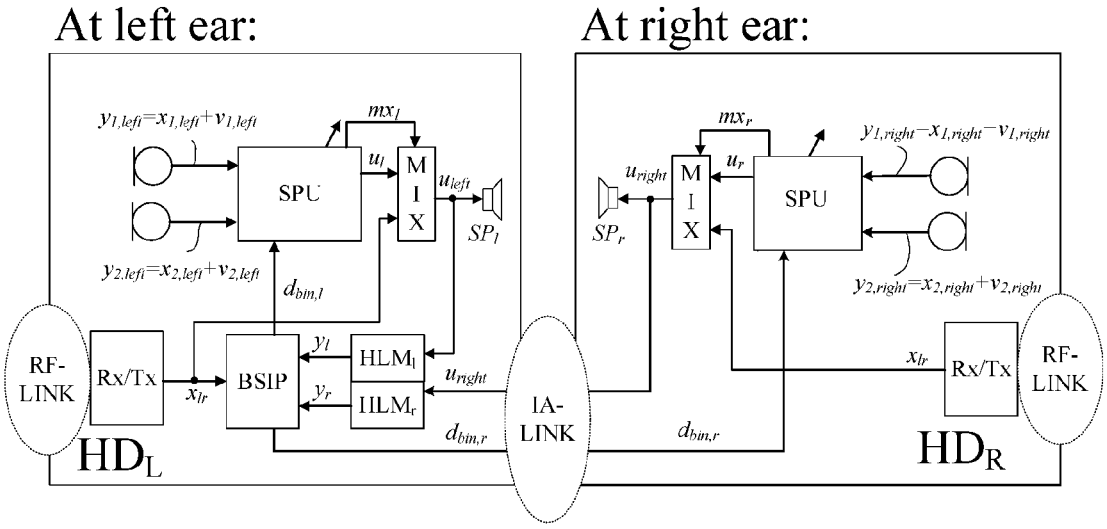

These signals $x_l(n)$, $x_r(n)$, and $y_l(n)$, $y_r(n)$ can be forwarded to the binaural speech intelligibility predictor unit and a resulting speech intelligibility predictor $d_{bin}$ (or respective left $d_{bin,l}$ and right $d_{bin,r}$ predictors, cf. e.g. FIG. 7) determined. By including a binaural hearing loss model (BHLM or respective left and right ear hearing loss models $HLM_l$, $HLM_r$, cf. e.g. FIG. 7), the effect of a hearing impairment can be included in the speech intelligibility prediction (and/or an adaptive system for modifying hearing aid processing to maximize the speech intelligibility predictor can be provided).

Alternatively, the recorded (electric) noise-free (clean) left and right target signals $x_l(n)$, $x_r(n)$, and a mixture $y_l(n)$, $y_r(n)$ of the clean target source and noise sound sources as (acoustically) received at the left and right hearing aids and picked up by microphones of the respective hearing aids can be provided to the binaural speech intelligibility predictor unit and a resulting binaural speech intelligibility predictor $d_{bin}$ (alternatively denoted SI measure or DBSTOI) determined. Thereby the effect on the resulting binaural speech intelligibility predictor $d_{bin}$ of changes in location, type and level of the noise sound sources $V_i$ can be evaluated (for a fixed sound source S).

By including a processing algorithm of a hearing aid, the binaural speech intelligibility prediction system can be used to test the effect of different algorithms on the resulting binaural speech intelligibility predictor. Alternatively or additionally, such setup can be used to test the effect of different parameter settings of a given algorithm (e.g. a noise reduction algorithm or a directionality algorithm) on the resulting binaural speech intelligibility predictor.

The setup of FIG. 4 can e.g. be used to generate electric noise-free (clean) left and right target signals $x_l(n)$, $x_r(n)$ as received at left and right ears from a single noise free target sound source (S in FIG. 4) subject to left and right head related transfer functions corresponding to the chosen location of the sound source (e.g. given by angle $\theta_S$).

Figure 5:
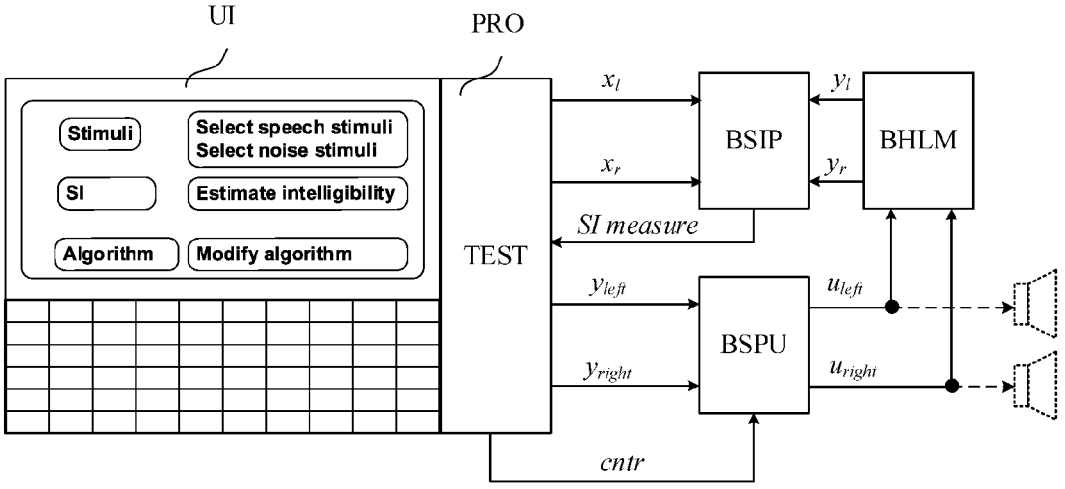
FIG. 5 shows a listening test system comprising a binaural speech intelligibility prediction unit according to the present disclosure.

FIG. 5 shows a listening test system (TEST) comprising a binaural speech intelligibility prediction unit (BSIP) according to the present disclosure. The test system may e.g. comprise a fitting system for a adapting a hearing aid or a pair of hearing aids to a particular persons' hearing impairment. Alternatively or additionally, the test system may comprise or form part of a development system for testing the impact of processing algorithms (or changes to processing algorithms) on an estimated speech intelligibility of the user (or of an average user having a specified, e.g. typical or special, hearing impairment).

The test system (TEST) comprises a user interface (UI) for initiating a test and/or for displaying results of a test. The test system further comprises a processing part (PRO) configured to provide predefined test signals, including a) left and right essentially noise-free versions $x_l$, $x_r$ of a target speech signal and b) left and right noisy and/or processed versions $y_{left}$, $y_{right}$ of the target speech signal. The signals $x_l$, $x_r$, $y_{left}$, $y_{right}$ are adapted to emulate signals as received or being representative of acoustic signals as received at left and right ears of a listener. The signals may e.g. be generated as described in connection with FIG. 4.

The test system (TEST) comprises a (binaural) signal processing unit (BSPU) that applies one or more processing algorithms to the left and right noisy and/or processed versions $y_{left}$, $y_{right}$ of the target speech signal and provides resulting processed signals $u_{left}$ and $u_{right}$.

The test system (TEST) further comprises a binaural hearing loss model (BHLM) for emulating the hearing loss (or deviation from normal hearing) of a user. The binaural hearing loss model (BHLM) receives processed signals $u_{left}$ and $u_{right}$ from the binaural signal processing unit (BSPU) and provides left and right modified processed signals $y_l$ and $y_r$, which are fed to the binaural speech intelligibility prediction unit (BSIP) as the left and right noisy and/or processed versions of the target signal. Simultaneously, the clean versions of the target speech signals $x_l$, $x_r$, are provided from the processing part (PRO) of the test system to the binaural speech intelligibility prediction unit (BSIP). The processed signals $u_{left}$ and $u_{right}$ may e.g. be fed to respective loudspeakers (indicated in dotted line) for acoustically presenting the signals to a listener.

The processing part (PRO) of the test system is further be configured to receive the resulting speech intelligibility predictor value SI measure and to process and/or present the result of the evaluation of the listeners' intelligibility of speech in the current noisy and processed signals $u_{left}$ and $u_{right}$ via the user interface UI. Based thereon, the effect of the current algorithm (or a setting of the algorithm) on speech intelligibility can be evaluated. In an embodiment, a parameter setting of the algorithm is changed in dependence of the value of the present resulting speech intelligibility predictor value SI measure (e.g. manually or automatically, e.g. according to a predefined scheme, e.g. via control signal cntr).

The test system (TEST) may e.g. be configured to apply a number of different (e.g. stored) test stimuli comprising speech located at different positions relative to the listener, and to mix it with one or more different noise sources, located at different positions relative to the listener, and having configurable frequency content and amplitude shaping. The test stimuli are preferably configurable and applied via the user interface (UI).

Intelligibility-Based Signal Selection.

Figure 6A:
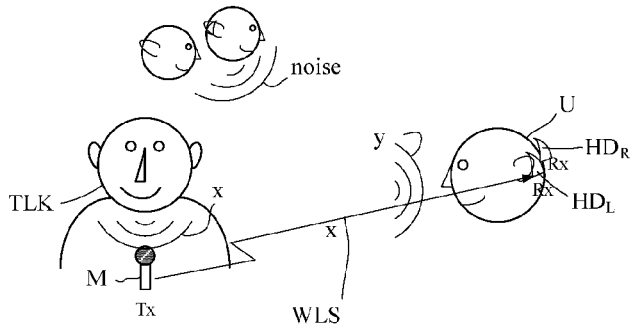
FIG. 6A shows a listening situation comprising a speaker in a noisy environment wearing a microphone comprising a transmitter for transmitting the speakers voice to a user wearing a binaural hearing system comprising left and right hearing aids according to the present disclosure.
Figure 6B:
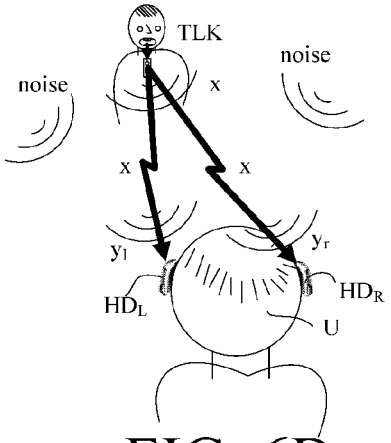
FIG. 6B shows the same listening situation as in FIG. 6A from another angle.
Figure 6C:
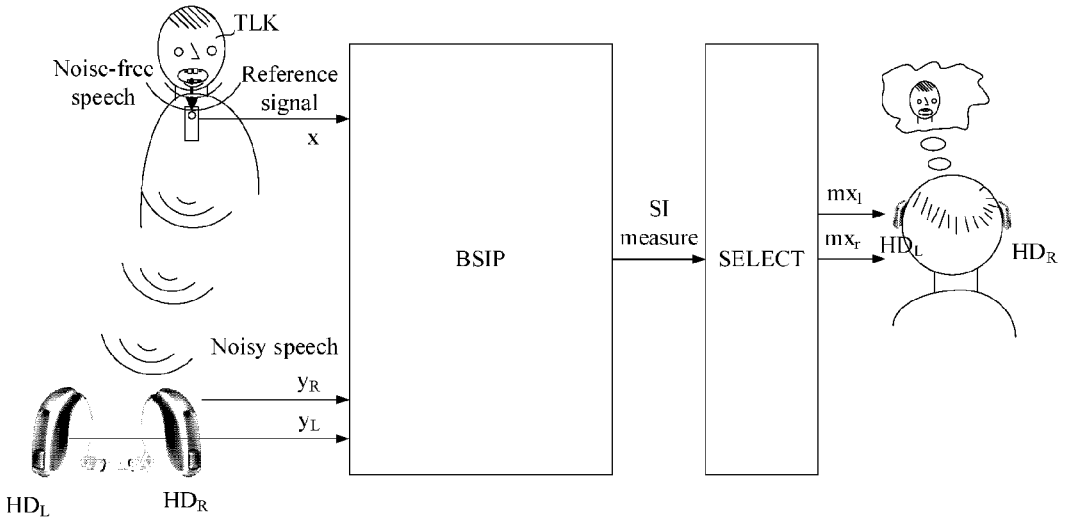
FIG. 6C illustrates the mixing of noise-free and noisy speech signals to provide a combined signal in a binaural hearing system based on speech intelligibility prediction of the combined signal as e.g. available in the listening situation of FIGS. 6A and 6B.
Figure 6D:
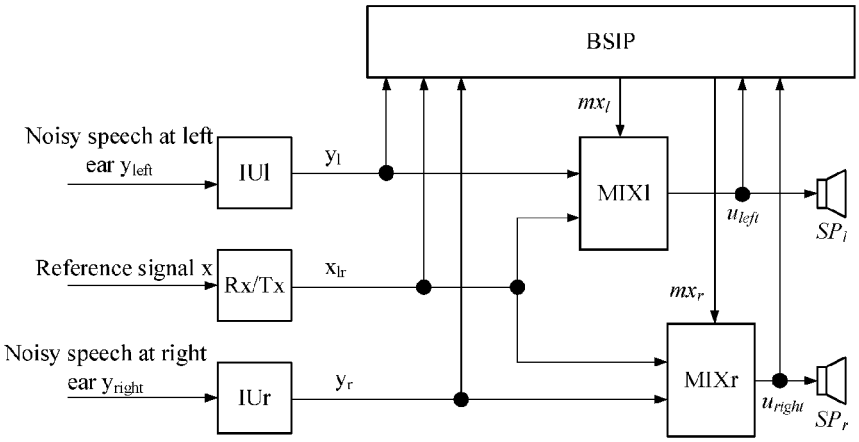
FIG. 6D shows an embodiment of a hearing binaural hearing system implementing the scheme illustrated in FIG. 6C, FIG. 7 schematically shows an exemplary embodiment of a binaural hearing system comprising left and right hearing aids according to the present disclosure, which can e.g. be used in the listening situation of FIGS. 6A, 6B and 6C.

FIGS. 6A and 6B illustrate various views of a listening situation comprising a speaker in a noisy environment wearing a microphone comprising a transmitter for transmitting the speakers voice to a user wearing a binaural hearing system comprising left and right hearing aids according to the present disclosure. FIG. 6C illustrates the mixing of noise-free and noisy speech signals to provide a combined signal in a binaural hearing system based on speech intelligibility prediction of the combined signal as e.g. available in the listening situation of FIGS. 6A and 6B. FIG. 6D shows an embodiment of a hearing binaural hearing system implementing the scheme illustrated in FIG. 6C.

FIGS. 6A and 6B shows a target talker (TLK) wearing a wireless microphone (M) able to pick up his voice (signal x) at a high signal-to-noise ratio (SNR) (due to the short distance between the mouth of the talker and the microphone). In an embodiment, the wireless microphone comprises a voice detection unit allowing the microphone to identify time segments where the a human voice is being picked up by the microphone. In an embodiment, the wireless microphone comprises an own voice detection unit allowing the microphone to identify time segments where the talker's voice is being picked up by the microphone. In an embodiment, the own voice detection unit has been trained to allow the detection of the talker's voice. The general idea is that the microphone signal (x) is wirelessly transmitted to the hearing instrument user by a transmitting unit (Tx), e.g integrated with the wireless microphone (M). In an embodiment, the signal picked up by the microphone is only transmitted when the a huna voice has been identified by a voice detection unit. In an embodiment, the signal picked up by the microphone is only transmitted when the talker's voice has been identified by an own voice detection unit. Therefore, the hearing impaired listener (U) wearing left and right hearing aids ($HD_L$, $HD_R$) at left and right ears has two different versions of the target speech signal available: a) the speech signal ($y_l$,$y_r$) picked up by the microphones of the left and right hearing aids, respectively, and b) the speech signal (x) picked up by the target talker's body-worn microphone and wirelessly transmitted to the left and right hearing aids of the user. Hereby we have two main options for presenting the speech signal to the listener (U) who is wearing the hearing instruments ($HD_L$, $HD_R$):

1. The listener may listen to the speech signal ($y_l$,$y_r$) picked up by the hearing instrument microphones.
2. The listener may listen to the speech signal (x) picked up by the microphone placed near the talker's mouth.

Option 1) has the advantage that the hearing instrument microphone signals ($y_l$,$y_r$) are recorded binaurally. Hereby the spatial perception of the speech signal is essentially correct, and the spatial cues may assist the listener to better understand the target talker. Furthermore, the (potential) acoustic noise present in the microphone signals of the hearing aid user may be reduced using the external microphone signal as side information (see e.g. our co-pending European patent application EP15190783.9 filed at the European Patent Office on 20 Oct. 2015), which is incorporated herein by reference. Even so, the SNR in this enhanced signal may still be very poor compared to the SNR at the external microphone.

Option 2) has the advantage that the SNR of the signal (x) picked up at the external microphone (M) close to the mouth of the target talker (TLK) most likely is much better than the SNR at the microphones of hearing instruments ($HD_L$, $HD_R$). While this signal (x) can be presented to the hearing aid user (U), the disadvantage is that we only have a mono version to present, so that any binaural spatial cues have to be restored artificially (see e.g. EP15190783.9 as referred to above).

For that reason, for high signal to noise ratio situations, where intelligibility degradation is not a problem, it is better to present the processed signals originally recorded at the hearing instrument microphones. On the other hand, if the SNR is very poor, it may be an advantage to trade the spatial cues for a better signal to noise ratio.

In order to decide which signal is the best to present to the listener in a given situation, a speech intelligibility model may be used. Most existing speech intelligibility models are monaural, see e.g. the one described in [Taal et al., 2011], while a few existing ones work on binaural signals, e.g. [Beutelmann&Brand; 2006]. For the idea presented in the present application, better performance is expected with a binaural model, but the basic idea does not require a binaural model. Most speech intelligibility models assume that a clean reference is available. Based on this clean reference signal and the noisy (and potentially processed) signal, it is possible to predict the speech intelligibility of the noisy/processed signal. With the wireless microphone situation described above and depicted in FIG. 6A, 6B, and as shown in FIG. 6C, the speech signal (x) recorded at the external microphone (M) is taken to be a 'clean reference signal' (Reference signal in FIG. 6C). Based on this reference, we can estimate the speech intelligibility at the hearing instrument microphones via a speech intelligibility model (cf. binaural speech intelligibility prediction unit BSIP in FIG. 6C). If the (estimated) speech intelligibility (cf. signal SI measure in FIG. 6C) at the hearing instrument microphones is sufficiently high, there is no reason to present the external microphone signal to the listener. By listening to the microphone signals ($y_l$,$y_r$) recorded (picked up) by the hearing instruments ($HD_L$, $HD_R$), we maintain the correct spatial perception of the talker (TLK). On the other hand, if the speech intelligibility (SI measure) of the local hearing instrument microphones is very low, it is better to present the external microphone signal (x) to the listener. In order to avoid fluctuating shifts between hearing instrument microphones and external microphones, it may be advantageous to implement hysteresis (and/or fading) into the signal selection.

So far, a binary choice between presenting 1) the speech signal picked up by the hearing instrument microphones, and 2) the speech signal picked up by the wireless microphone has been discussed. It may be useful to generalize this idea. Specifically, one could present an appropriate combination of the two signals. In particular, for linear combinations, the presented signal $u_{local}$ is given by $$u_{local}=a*y_{local}+(1-a)*x_{wireless},$$

where $y_{local}$ is the microphone signal of the hearing aid user (local=left or right), and $x_{wireless}$ is the signal (=signal x in FIG. 6A, 6B, 6C, 6D) picked up at the target talker (TLK) and wirelessly transmitted to the hearing aid(s), and $0<=a<=1$ is a free parameter. The goal is now to find an appropriate value of the constant a, which is optimal in terms of intelligibility. This could be achieved by simply synthesizing different versions of it based on different pre-chosen values of a, and evaluating the resulting intelligibility using the intelligibility model. The value of a that leads to highest (predicted) intelligibility is then used. In the embodiment of a binaural hearing system shown in FIG. 6D, the above scheme may be implemented as a lookup table of corresponding values of the constant a and the speech intelligibility predictor SI measure, e.g. stored in the binaural speech intelligibility prediction unit (BSIP) in FIG. 6D. In an embodiment, a value of the SI measure (e.g. $d_{bin,l}$, $d_{bin,r}$ in FIG. 7) is determined for each of the left and right hearing instruments ($HD_L$, $HD_R$) based on respective signal pairs ($y_l$, $x_{lr}$) and ($y_r$,$x_{lr}$). Noisy target signals $y_l$ and $y_r$ are the electric input signals provided by input units IUl and IUr based on signals $y_{left}$ and $y_{right}$, respectively, (denoted Noisy speech at left ear and Noisy speech at right ear, respectively, in FIG. 6D). Clean target signal $x_{lr}$ is the electric input signal provided by transceiver unit Rx/Tx, e.g. as received from microphone M in FIG. 6A. The electric input signals $y_l$, $y_r$ and $x_{lr}$ are fed to the binaural signal prediction unit BSIP. The signal pairs ($y_l$, $x_{lr}$) and ($y_r$,$x_{lr}$) are fed to left and right mixing units MIXl and MIXr, respectively. The mixing units mix the respective input signals, e.g. as a weighted (linear) combination of the input signals, and provide resulting left and right signals $u_{left}$ and $u_{right}$, respectively (cf. below). The resulting signals are e.g. further processed, and/or fed to respective output units (here loudspeakers) $SP_l$, $SP_r$, respectively, for presentation to the user of the binaural hearing system. The resulting signals are optionally fed to the binaural speech intelligibility unit BSIP, e.g. to allow an adaptive improvement of the mixing control signals $mx_l$, $mx_r$. The estimated best mixture (from a speech intelligibility point of view) as defined by constant a may be determined as the separate values of the constant a (e.g. $a_l(d_{bin,l})$, $a_r(d_{bin,r})$) in the lookup table corresponding to the present values of the SI measure (e.g. $d_{bin,l}$, $d_{bin,r}$) in the left and right hearing aids ($HD_L$, $HD_R$), respectively. With reference to FIG. 6D, the resulting left and right signals $u_{left}$ and $u_{right}$ provided by the mixing units MIXl and MIXr, respectively, of the left and right hearing instruments may thus be determined as $$u_{left}=a_l*y_{left}+(1-a_l)*x_{lr}, \text{ and}$$

$$u_{right}=a_r*y_{right}+(1-a_r)*x_{lr}.$$

The left and right mixing units MIXl, MIXr are configured to apply mixing constants $a_l$, $a_r$ as indicated in the above equations via mixing control signals $mx_l$, $mx_r$.

In an embodiment, the binaural hearing system is configured to provide that $0<a_l$, $a_r<1$. In an embodiment, the binaural hearing system is configured to provide that $0\leq a_l$, $a_r\leq 1$.

In an embodiment, $a_l=a_r=a$ and determined from a the binaural speech intelligibility model, so that $$u_{left}=a*y_{left}+(1-a)*x_{lr}, \text{ and}$$

$$u_{right}=a*y_{right}+(1-a)*x_{lr}.$$

Thus the mixing control signals $mx_l$, $mx_r$ (cf. FIG. 6D) may be identical.

In an embodiment, the binaural hearing system is configured to provide that $0<a<1$. In an embodiment, the binaural hearing system is configured to provide that $0\leq a\leq 1$.

In an embodiment, the mixing constant(s) is(are) adaptively determined based on an estimate of the resulting left and right signals $u_{left}$ and $u_{right}$ based on an optimization of the speech intelligibility predictor provided by the BSIP unit. An embodiment, of a binaural hearing system implementing an adaptive optimization of the mixing ratio of clean and noisy versions of the target signal is described in the following (FIG. 7).

FIG. 7 shows an exemplary embodiment of a binaural hearing system comprising left and right hearing aids, e.g. hearing aids, ($HD_L$, $HD_R$) according to the present disclosure, which can e.g. be used in the listening situation of FIGS. 6A, 6B and 6C.

FIG. 7 shows an embodiment of a binaural hearing aid system according to the present disclosure comprising a binaural speech intelligibility predictor system (BSIP) for estimating the perceived intelligibility of the user when presented with the respective left and right output signals $u_{left}$ and $u_{right}$ of the binaural hearing aid system (via left and right loudspeakers $SP_l$ and $SP_r$, respectively) and using the resulting predictor to adapt the processing (in respective processing units SPU of hearing aids $HD_L$, $HD_R$) of respective input signals $y_{left}$ and $y_{right}$ comprising speech to maximize the binaural speech intelligibility predictor. This is done by feeding the output signals $u_{left}$ and $u_{right}$ presented to the user via output respective units (here loudspeakers) to a binaural hearing loss model (here comprising individual models $HLM_l$, $HLM_r$ of the left and right ears) that models the (impaired) auditory system of the user and presents resulting left and right signals $y_l$ and $y_r$ to the binaural speech intelligibility prediction system (BSIP). The configurable signal processing units (SPU) are adapted to (adaptively) control the processing of the respective electric input signals ($y_{1,left}$, $y_{2,left}$) and ($y_{1,right}$, $y_{2,right}$) based on the final binaural speech intelligibility control signal $d_{bin,l}$ and $d_{bin,r}$ (reflecting the current binaural speech intelligibility measure) to maximize the users' intelligibility of the output sound signals $u_{left}$ and $u_{right}$.

FIG. 7 illustrates an alternative to the scheme for determining the optimal mixture of the noisy version of the target signal picked up by the microphones of the hearing aids and the wirelessly received clean version of the target signal discussed in connection with FIG. 6D.

FIG. 7 shows an embodiment of a binaural hearing system comprising left and right hearing aids ($HD_L$, $HD_R$) according to the present disclosure. The left and right hearing aids are adapted to be located at or in left and right ears (At left ear, At right ear in FIG. 7) of a user. The signal processing of each of the left and right hearing aids is guided by an estimate of the speech intelligibility of the signals presented at the ears of and thus as experienced by the hearing aid user. The binaural speech intelligibility predictor unit (BSIP) is configured to take as inputs the output signals $u_{left}$, $u_{right}$ of left and hearing aids as modified by a hearing loss model ($HLM_{left}$, $HLM_{right}$, respectively, in FIG. 7) for the respective left and right ears of the user, respectively (to model imperfections of an impaired auditory system of the user). At least one of, such as both of (as shown in FIG. 7), the left and right hearing aids comprise a transceiver unit Rx/Tx for (via a wireless link, RF-LINK in FIG. 7) receiving a signal comprising a clean (essentially noise-free) version of the target signal x (e.g. from microphone M in the scenario of FIG. 6A) and provides clean electric input signal $x_{lr}$. In the embodiment of FIG. 7, the same version of the clean target signal $x_{lr}$ is received at both hearing aids. Alternatively individualized versions $x_l$, $x_r$ (e.g. reflecting spatial cues) of the clean target signal may be received by the respective left and right hearing aids. The binaural speech intelligibility prediction unit (BSIP) provides a binaural speech intelligibility predictor (e.g. in the form of left and right SI-predictor signals $d_{bin,l}$, $d_{bin,l}$ from the binaural speech intelligibility predictor (BSIP) to the respective signal processing units (SPU) of the left and right hearing aids ($HD_L$, $HD_R$)).

In the embodiment of FIG. 7, the speech intelligibility estimation/prediction takes place in the left-ear hearing aid ($HD_L$). The output signal $u_{right}$ of the right-ear hearing aid ($HD_R$) is transmitted to the left-ear hearing aid ($HD_L$) via an interaural communication link IA-LINK. The interaural communication link may be based on a wired or wireless connection (and on near-field or far-field communication). The hearing aids ($HD_L$, $HD_R$) are preferably wirelessly connected.

Each of the hearing aids ($HD_L$, $HD_R$) comprise two microphones, a signal processing unit (SPU), a mixing unit (MIX), and a loudspeaker ($SP_l$, $SP_r$). Additionally, one or both of the hearing aids comprise a binaural speech intelligibility unit (BSIP). The two microphones of each of the left and right hearing aids each pick up a—potentially noisy (time varying) signal y(t) (cf. $y_{1,left}$, $y_{2,left}$ and $y_{1,right}$, $y_{2,right}$ in FIG. 7)—which generally consists of a target signal component x(t) (cf. $x_{1,left}$, $x_{2,left}$ and $x_{1,right}$, $x_{2,right}$ in FIG. 7) and an undesired (noise) signal component v(t) (cf. $v_{1,left}$, $v_{2,left}$ and $v_{1,right}$, $v_{2,right}$ in FIG. 7). In FIG. 7, the subscripts 1, 2 indicate a first and second (e.g. front and rear) microphone, respectively, while the subscripts left, right or l, r, indicate whether it relates to the left or right ear hearing aid ($HD_L$, $HD_R$), respectively).

Based on binaural speech intelligibility prediction system (BSIP), the signal processing units (SPU) of each hearing aid may be (individually) adapted (cf. control signals $d_{bin,l}$, $d_{bin,r}$). Since, in the embodiment of FIG. 7, the binaural speech intelligibility prediction unit is located in the left-ear hearing aid ($HD_L$), adaptation of the processing in the right-ear hearing aid ($HD_R$) requires control signal $d_{bin,r}$ to be transmitted from left to right-ear hearing aid via interaural communication link (IA-LINK).

In FIG. 7, each of the left and right hearing aids comprise two microphones. In other embodiments, each (or one) of the hearing aids may comprises three or more microphones. Likewise, in FIG. 7, the binaural speech intelligibility predictor (BSIP) is located in the left hearing aid ($HD_L$). Alternatively, the binaural speech intelligibility predictor (BSIP) may be located in the right hearing aid ($HD_R$), or alternatively in both, preferably performing the same function in each hearing aid. The latter embodiment consumes more power and requires a two-way exchange of output audio signals ($u_{left}$, $u_{right}$), whereas the transfer of processing control signal(s) ($d_{bin,r}$ in FIG. 7) can be omitted. In still another embodiment, the binaural speech intelligibility predictor unit (BSIP) is located in a separate auxiliary device, e.g. a remote control (e.g. embodied in a SmartPhone), requiring that an audio link can be established between the hearing aids and the auxiliary device for receiving output signals ($u_{left}$, $u_{right}$) from, and transmitting processing control signals ($d_{bin,l}$, $d_{bin,r}$) to, the respective hearing aids ($HD_L$, $HD_R$).

Figure 8:
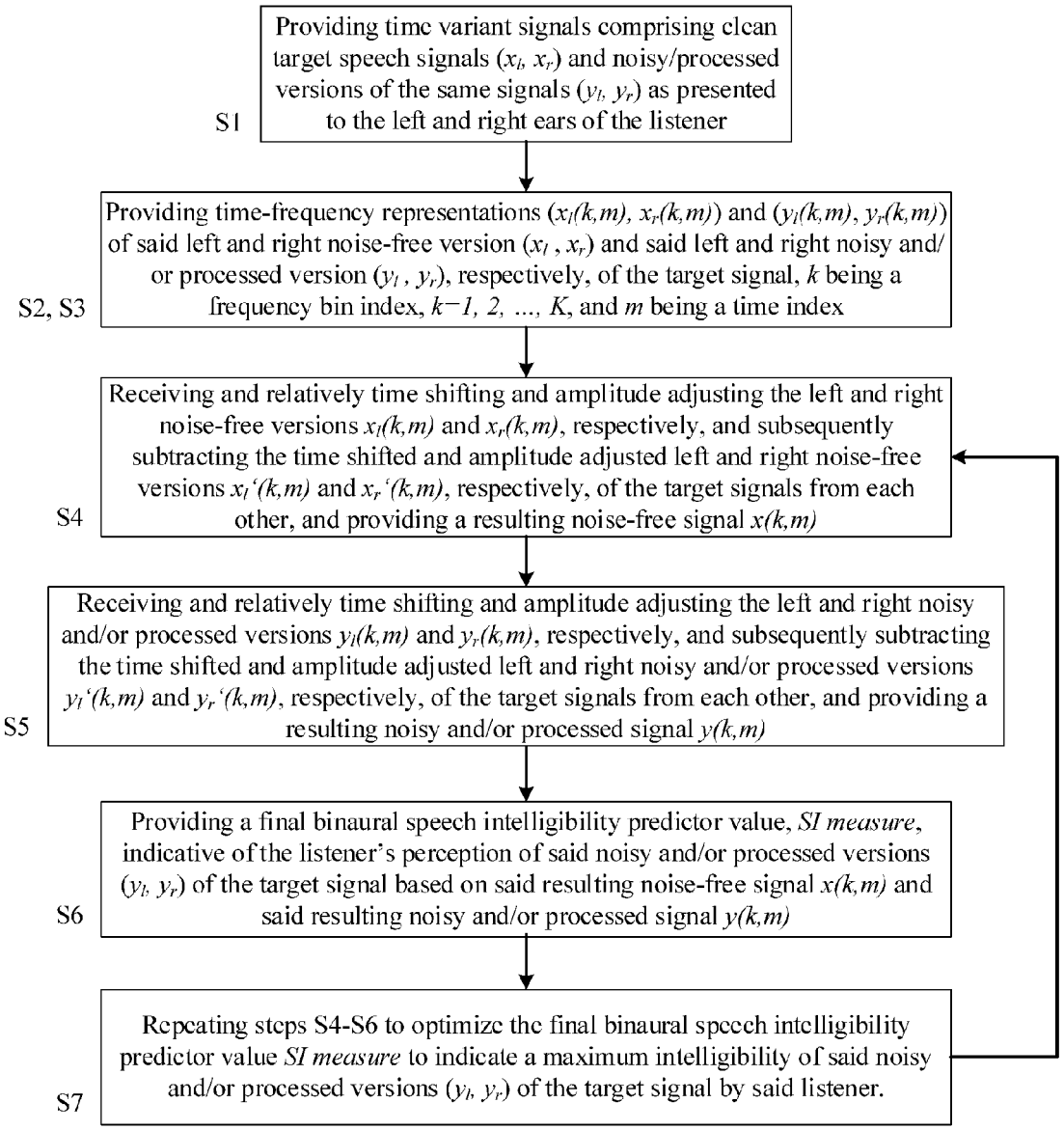
FIG. 8 shows an embodiment of a method of providing a binaural speech intelligibility predictor value.

FIG. 8 shows a flow diagram for an embodiment of a method of providing a binaural speech intelligibility predictor value. The method comprises S1. Providing or receiving a target signal comprising speech in a) left and right essentially noise-free versions $x_l$, $x_r$ and in b) left and right noisy and/or processed versions $y_l$, $y_r$, said signals being received or being representative of acoustic signals as received at left and right ears of a listener;

S2. Providing time-frequency representations $x_l(k,m)$ and $y_l(k,m)$ of said left noise-free version $x_l$ and said left noisy and/or processed version $y_l$ of the target signal, respectively, k being a frequency bin index, k=1, 2, . . . , K, and m being a time index;

S3. Providing time-frequency representations $x_r(k,m)$ and $y_r(k,m)$ of said right noise-free version $x_r$ and said right noisy and/or processed version $y_r$ of the target signal, respectively, k being a frequency bin index, k=1, 2, . . . , K, and m being a time index;

S4. Receiving and relatively time shifting and amplitude adjusting the left and right noise-free versions $x_l(k,m)$ and $x_r(k,m)$, respectively, and subsequently subtracting the time shifted and amplitude adjusted left and right noise-free versions $x_l'(k,m)$ and $x_r'(k,m)$, respectively, of the target signals from each other, and providing a resulting noise-free signal x(k,m);

S5. Receiving and relatively time shifting and amplitude adjusting the left and right noisy and/or processed versions $y_l(k,m)$ and $y_r(k,m)$, respectively, and subsequently subtracting the time shifted and amplitude adjusted left and right noisy and/or processed versions $y'_l(k,m)$ and $y'_r(k,m)$, respectively, of the target signals from each other, and providing a resulting noisy and/or processed signal y(k,m);

S6. Providing a final binaural speech intelligibility predictor value SI measure indicative of the listener's perception of said noisy and/or processed versions $y_l$, $y_r$ of the target signal based on said resulting noise-free signal x(k,m) and said resulting noisy and/or processed signal y(k,m);

S7. Repeating steps S4-S6 to optimize the final binaural speech intelligibility predictor value SI measure to indicate a maximum intelligibility of said noisy and/or processed versions $y_l$, $y_r$ of the target signal by said listener.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[Andersen et al.; 2015] A. H. Andersen, J. M. de Haan, Z. Tan, and J. Jensen, "A binaural short time objective intelligibility measure for noisy and enhanced speech," in INTERSPEECH, Dresden, Germany, September 2015, pp. 2563-2567, 2015.

[Andersen et al.; 2016] A. H. Andersen, J. M. de Haan, Z. Tan, and J. Jensen, "A method for predicting the intelligibility of noisy and non-linearly enhanced binaural speech", To be presented at ISCASP 2016, Shanghai, China, 20-25 Mar. 2016, Published in: IEEE International Conference on Acoustics, Speech and Signal Processing (ICASSP), pp. 4995-4999, 2016.

[ANSI S3.5-1997] American National Standards Institute, "S3.5-1997: Methods for calculation of the speech intelligibility index," 1997.

[Beutelmann&Brand; 2006] Beutelmann, R. and Brand, T., "Prediction of speech intelligibility in spatial noise and reverberation for normal-hearing and hearing-impaired listeners," J. Acoust. Soc. Am., Vol. 120, pp. 331-342, 2006.

[Bronkhorst; 2000] A. W. Bronkhorst, "The cocktail party phenomenon: A review on speech intelligibility in multiple-talker conditions," Acta Acustica United with Acustica, vol. 86, no. 1, pp. 117-128, January 2000.

[Falk et al.; 2015] T. H. Falk, V. Parsa, J. F. Santos, K. Arehart, O. Hazrati, R. Huber, J. M. Kates, and S. Scollie, "Objective quality and intelligibility prediction for users of assistive listening devices," IEEE Signal Processing Magazine, vol. 32, no. 2, pp. 114-124, March 2015.

[French & Steinberg; 1947] N. R. French and J. C. Steinberg, "Factors governing the intelligibility of speech sounds," J. Acoust. Soc. Am., vol. 19, no. 1, pp. 90-119, January 1947.

[Durlach; 1963] N. I. Durlach, "Equalization and cancellation theory of binaural masking-level differences", J. Acoust. Soc. Am., vol. 35, no. 8, pp. 1206-1218, August 1963.

[Durlach; 1972] N. I. Durlach, "Binaural signal detection: Equalization and cancellation theory", in Foundations of Modern Auditory Theory Volume II, Jerry V. Tobias, Ed., pp. 371-462. Academic Press, New York, 1972.

[Taal et al.; 2011] Taal, C., Hendriks, R., Heusdens, R., and Jensen, J., "An algorithm for intelligibility prediction of time-frequency weighted noisy speech," IEEE Trans. Audio, Speech, Lang. Process., Vol. 19, pp. 2125-2136, 2011.

[Taal et al.; 2012] C. H. Taal, R. C. Hendriks, and R. Heusdens, "Matching pursuit for channel selection in coclear implants based on an intelligibility metric," in Proceedings of the 20th European Signal Processing Conference (EUSIPCO), Bucharest, Romania, August 2012, pp. 504-508.

The invention claimed is:

1. An intrusive binaural speech intelligibility prediction system comprising a binaural speech intelligibility predictor unit adapted for receiving a target signal comprising speech in a) left and right essentially noise-free versions $x_l$, $x_r$ and in b) left and right noisy and/or processed versions $y_l$, $y_r$, said signals being received or being representative of acoustic signals as received at left and right ears of a listener, the binaural speech intelligibility predictor unit being configured to provide as an output a final binaural speech intelligibility predictor value SI measure indicative of the listener's perception of said noisy and/or processed versions $y_l$, $y_r$ of the target signal, the binaural speech intelligibility predictor unit comprising First and second input units for providing time-frequency representations $x_l(k,m)$ and $x_r(k,m)$ of said left $x_l$ and right $x_r$ noise-free version of the target signal, respectively, k being a frequency bin index, k=1, 2, . . . , K, and m being a time index;

Third and fourth input units for providing time-frequency representations $y_l(k,m)$ and $y_r(k,m)$ of said left $y_l$ and right $y_r$ noisy and/or processed versions of the target signal, respectively, k being a frequency bin index, k=1, 2, . . . , K, and m being a time index;

A first Equalization-Cancellation stage adapted to receive and relatively time shift and amplitude adjust the left and right noise-free versions $x_l(k,m)$ and $x_r(k,m)$, respectively, and to subsequently subtract the time shifted and amplitude adjusted left and right noise-free versions $x'_l(k,m)$ and $x'_r(k,m)$ of the left and right target signals from each other, and to provide a resulting noise-free signal x(k,m);

A second Equalization-Cancellation stage adapted to receive and relatively time shift and amplitude adjust the left and right noisy and/or processed versions $y_l(k,m)$ and $y_r(k,m)$, respectively, and to subsequently subtract the time shifted and amplitude adjusted left and right noisy and/or processed versions $y'_l(k,m)$ and $y'_r(k,m)$ of the left and right target signals from each other, and to provide a resulting noisy and/or processed signal y(k,m); and A monaural speech intelligibility predictor unit for providing final binaural speech intelligibility predictor value SI measure based on said resulting noise-free signal x(k,m) and said resulting noisy and/or processed signal y(k,m);

Wherein said first and second Equalization-Cancellation stages are adapted to optimize the final binaural speech intelligibility predictor value SI measure to indicate a maximum intelligibility of said noisy and/or processed versions $y_l$, $y_r$ of the target signal by said listener.

2. An intrusive binaural speech intelligibility prediction system according to claim 1 configured to repeat the calculations performed by the first and second Equalization-Cancellation stages and the monaural speech intelligibility predictor unit to optimize the final binaural speech intelligibility predictor value to indicate a maximum intelligibility of said noisy and/or processed versions of the target signal by said listener.

3. An intrusive binaural speech intelligibility prediction system according to claim 1 wherein the monaural speech intelligibility predictor unit comprises A first envelope extraction unit for providing a time-frequency sub-band representation of the resulting noise-free signal x(k,m) in the form of temporal envelopes, or functions thereof, of said resulting noise-free signal providing time-frequency sub-band signals X(q, m), q being a frequency sub-band index, q=1, 2, . . . , Q, and m being the time index;

A second envelope extraction unit for providing a time-frequency sub-band representation of the resulting noisy and/or processed signal y(k,m) in the form of temporal envelopes, or functions thereof, of said resulting noisy and/or processed signal providing time-frequency sub-band signals Y(q,m), q being a frequency sub-band index, q=1, 2, Q, and m being the time index;

A first time-frequency segment division unit for dividing said time-frequency sub-band representation X(q,m) of the resulting noise-free signal y(k,m) into time-frequency envelope segments x(q,m) corresponding to a number N of successive samples of said sub-band signals;

A second time-frequency segment division unit for dividing said time-frequency sub-band representation Y(q, m) of the noisy and/or processed signal y(k,m) into time-frequency envelope segments y(q,m) corresponding to a number N of successive samples of said sub-band signals;

A correlation coefficient unit adapted to compute a correlation coefficient $\hat{\rho}(q, m)$ between each time frequency envelope segment of the noise-free signal and the corresponding envelope segment of the noisy and/or processed signal;

A final speech intelligibility measure unit providing a final binaural speech intelligibility predictor value SI measure as a weighted combination of the computed correlation coefficients across time frames and frequency sub-bands.

4. An intrusive binaural speech intelligibility prediction system according to claim 1 comprising a binaural hearing loss model.

5. A binaural hearing system comprising left and right hearing aids adapted to be located at left and right ears of a user, and an intrusive binaural speech intelligibility prediction system according to claim 1.

6. A binaural hearing system according to claim 5, wherein of the left and right hearing aids comprises left and right configurable signal processing units configured for processing the left and right noisy and/or processed versions $y_l$, $y_r$, of the target signal, respectively, and providing left and right processed signals $u_{left}$, $u_{right}$, respectively, and left and right output units for creating output stimuli configured to be perceivable by the user as sound based on left and right electric output signals, either in the form of the left and right processed signals $u_{left}$, $u_{right}$, respectively, or signals derived therefrom, wherein the binaural hearing system comprises a) a binaural hearing loss model unit operatively connected to the intrusive binaural speech intelligibility predictor unit and configured to apply a frequency dependent modification reflecting a hearing impairment of the corresponding left and right ears of the user to the electric output signals to provide respective modified electric output signals to the intrusive binaural speech intelligibility predictor unit.

7. A binaural hearing system according to claim 5 wherein of the left and right hearing aids comprises antenna and transceiver circuitry for establishing an interaural link between them allowing the exchange of data between them, including audio and/or control data signals.

8. Use of an intrusive binaural speech intelligibility prediction system as claimed in claim 1 in listening test for evaluating a person's intelligibility of a noisy and/or processed target signal comprising speech.

9. A method of providing a binaural speech intelligibility predictor value, the method comprising S1. receiving a target signal comprising speech in a) left and right essentially noise-free versions $x_l$, $x_r$ and in b) left and right noisy and/or processed versions $y_l$, $y_r$, said signals being received or being representative of acoustic signals as received at left and right ears of a listener, the method further comprises S2. providing time-frequency representations $x_l(k,m)$ and $y_l(k,m)$ of said left noise-free version $x_l$ and said left noisy and/or processed version $y_l$ of the target signal, respectively, k being a frequency bin index, k=1, 2, . . . , K, and m being a time index;

S3. providing time-frequency representations $x_r(k,m)$ and $y_r(k,m)$ of said right noise-free version $x_r$ and said right noisy and/or processed version $y_r$ of the target signal, respectively, k being a frequency bin index, k=1, 2, . . . , K, and m being a time index;

S4. receiving and relatively time shifting and amplitude adjusting the left and right noise-free versions $x_l(k,m)$ and $x_r(k,m)$, respectively, and subsequently subtracting the time shifted and amplitude adjusted left and right noise-free versions $x_l'(k,m)$ and $x_r'(k,m)$, respectively, of the target signals from each other, and providing a resulting noise-free signal x(k,m);

S5. receiving and relatively time shifting and amplitude adjusting the left and right noisy and/or processed versions $y_l(k,m)$ and $y_r(k,m)$, respectively, and subsequently subtracting the time shifted and amplitude adjusted left and right noisy and/or processed versions $y'_l(k,m)$ and $y'_r(k,m)$, respectively, of the target signals from each other, and providing a resulting noisy and/or processed signal y(k,m); and S6. providing a final binaural speech intelligibility predictor value SI measure indicative of the listener's perception of said noisy and/or processed versions $y_l$, $y_r$ of the target signal based on said resulting noise-free signal x(k,m) and said resulting noisy and/or processed signal y(k,m);

S7. repeating steps S4-S6 to optimize the final binaural speech intelligibility predictor value SI measure to indicate a maximum intelligibility of said noisy and/or processed versions $y_l$, $y_r$ of the target signal by said listener.

10. A method according to claim 9 wherein steps S4 and S5 each comprises providing that the relative time shift and amplitude adjustment is given by the factor:

$$\lambda=10^{(\gamma+\Delta\gamma)/40}e^{j\omega(\tau+\Delta\tau)/2}$$

where τ denoted time shift in seconds and γ denotes amplitude adjustment in dB, and where Δτ and Δγ are uncorrelated noise sources which model imperfections of the human auditory system of a normally hearing person, and where the resulting noise-free signal x(k,m) and the resulting noisy and/or processed signal y(k,m) is given by:

$$x_{k,m}=\lambda x_{k,m}^{(l)}-\lambda^{-1}x_{k,m}^{(r)},$$

and $$y_{k,m}=\lambda y_{k,m}^{(l)}-\lambda^{-1}y_{k,m}^{(r)},$$

respectively.

11. A method of according to claim 10 wherein the uncorrelated noise sources, Δτ and Δγ, are normally distributed with zero mean and standard deviation $$\sigma_{\Delta\gamma}(\gamma)=\sqrt{2}\cdot 1.5\text{ dB}\cdot\left(1+\left(\frac{|\gamma|}{13\text{ dB}}\right)^{1.6}\right)\text{ [dB]}$$

$$\sigma_{\Delta\gamma}(\gamma)=\sqrt{2}\cdot 65\cdot 10^{-6}s\cdot\left(1+\frac{|\tau|}{0.0016\ s}\right)\ [s]$$

and where the values γ and τ are determined such as to maximize the intelligibility predictor value.

12. A method of according to claim 9 wherein step S6 comprises providing a time-frequency sub-band representation of the resulting noise-free signal x(k,m) in the form of temporal envelopes, or functions thereof, of said resulting noise-free signal providing time-frequency sub-band signals X(q,m), q being a frequency sub-band index, q=1, 2, . . . , Q, and m being the time index;

providing a time-frequency sub-band representation of the resulting noisy and/or processed signal y(k,m) in the form of temporal envelopes, or functions thereof, of said resulting noisy and/or processed signal providing time-frequency sub-band signals Y(q,m), q being a frequency sub-band index, q=1, 2, . . . , Q, and m being the time index;

dividing said time-frequency sub-band representation X(q,m) of the resulting noise-free signal x(k,m) into time-frequency envelope segments x(q,m) corresponding to a number N of successive samples of said sub-band signals;

dividing said time-frequency sub-band representation Y(q,m) of the noisy and/or processed signal y(k,m) into time-frequency envelope segments y(q,m) corresponding to a number N of successive samples of said sub-band signals;

computing a correlation coefficient ρ(q,m) between each time frequency envelope segment of the noise-free signal and the corresponding envelope segment of the noisy and/or processed signal;

providing a final binaural speech intelligibility predictor value SI measure as a weighted combination of the computed correlation coefficients across time frames and frequency sub-bands.

13. A method according to claim 12 wherein said time-frequency signals X(q,m), X(q,m), q being a frequency sub-band index, q=1, 2, . . . , Q, representing temporal envelopes of the respective $q^{th}$ sub-band signals are power envelopes determined as $$X_{q,m} = \sum_{k=k_1(q)}^{k_2(q)} |y_{k,m}|^2$$

and $$Y_{q,m} = \sum_{k=k_1(q)}^{k_2(q)} |y_{k,m}|^2$$

respectively, where $k_1(q)$ and $k_2(q)$ denote lower and upper DFT-bins for the $q^{th}$ band, respectively.

14. A method according to claim 13 wherein the power envelopes are arranged into vectors of N samples $$x_{q,m}=[X_{q,m-N+1}, X_{q,m-N+2}, \ldots, X_{q,m}]^T \text{ and}$$

$$y_{q,m}=[Y_{q,m-N+1}, Y_{q,m-N+2}, \ldots, Y_{q,m}]^T$$

where vectors $x_{q,m}$ and $y_{q,m} \in \mathbb{R}^{N\times 1}$.

15. A method according to claim 14 wherein the correlation coefficient between clean and noisy/processed envelopes are determined as:

$$\rho_q = \frac{E[(X_{q,m} - E[X_{q,m}])(Y_{q,m} - E[Y_{q,m}])]}{\sqrt{E[(X_{q,m} - E[X_{q,m}])^2]E[(Y_{q,m} - E[Y_{q,m}])^2]}},$$

where the expectation is taken across both input signals and the noise sources $\Delta\tau$ and $\Delta\gamma$.

16. A method according to claim 15 wherein an N-sample estimate $\hat{\rho}_{q,m}$ of the correlation coefficient $\rho_q$ across the input signals is then given by:

$$\hat{\rho}_{q,m} = \frac{E_\Delta[(x_{q,m} - 1\mu_{x_{q,m}})^T(y_{q,m} - 1\mu_{y_{q,m}})]}{\sqrt{E_\Delta[\|x_{q,m} - 1\mu_{x_{q,m}}\|^2]E_\Delta[\|y_{q,m} - 1\mu_{y_{q,m}}\|^2]}}, \quad (9)$$

where $\mu(\bullet)$ denotes the mean of the entries in the given vector, $E_\Delta$ is the expectation across the noise applied in steps S4, S4 and 1 is the vector of all ones.

17. A method according to claim 16 wherein the final binaural speech intelligibility predictor value is obtained by estimating the correlation coefficients, $\hat{\rho}_{q,m}$, for all frames, in, and frequency bands, q, in the signal and averaging across these:

$$DBSTOI = \frac{1}{QM}\sum_{q=1}^{Q}\sum_{m=1}^{M}\hat{\rho}_{q,m},$$

where Q and M is the number of frequency sub-bands and the number of frames, respectively.

18. A data processing system comprising a processor and program code means for causing the processor to perform the steps of the method according to claim 9.

19. A tangible computer-readable medium storing a computer program comprising program code means for causing a data processing system to perform the steps of the method according to claim 9.

* * * * *